US008408405B2

(12) United States Patent
Yang et al.

(10) Patent No.: US 8,408,405 B2
(45) Date of Patent: Apr. 2, 2013

(54) SHELVING SYSTEM

(75) Inventors: Frank Yang, Rancho Palos Verdes, CA (US); Tzu-Hao Wei, Hacienda Heights, CA (US); Myk Wayne Lum, Irvine, CA (US); Adam C. Wade, Rancho Santa Margarita, CA (US)

(73) Assignee: simplehuman, LLC, Torrance, CA (US)

( * ) Notice: Subject to any disclaimer, the term of this patent is extended or adjusted under 35 U.S.C. 154(b) by 0 days.

(21) Appl. No.: 13/149,717

(22) Filed: May 31, 2011

(65) Prior Publication Data

US 2011/0271438 A1 Nov. 10, 2011

Related U.S. Application Data

(63) Continuation of application No. 11/670,391, filed on Feb. 1, 2007, now abandoned, which is a continuation-in-part of application No. 11/477,755, filed on Jun. 29, 2006, now Pat. No. 8,225,946.

(51) Int. Cl.
*A47G 29/087* (2006.01)
*A47B 9/08* (2006.01)

(52) U.S. Cl. ..... 211/90.02; 108/108; 248/235; 211/119.009; 211/103

(58) Field of Classification Search ..... 211/71.01, 211/87.01, 88.01, 90.02, 90.03, 90.04, 99, 211/103, 106, 107, 119, 126.1, 126.9, 133.5, 211/153, 175, 187, 190, 207, 126.5, 193; 108/42, 107, 108, 110, 146, 147.12, 147.14, 108/147.17, 147.18, 148, 152, 10, 95, 105, 108/144.11, 147.22; 248/243–245, 246, 248/222.11, 222.12, 223.41, 226.11, 227.3, 248/228.5, 229.1, 229.13, 229.14, 229.15, 248/229.24; D6/525; 24/495; 269/95, 254 CS
See application file for complete search history.

(56) References Cited

U.S. PATENT DOCUMENTS

| | | | |
|---|---|---|---|
| 141,186 | A | 7/1873 | Thomas |
| 163,852 | A | 6/1875 | Denman |
| 181,593 | A | 8/1876 | Randall |
| 387,758 | A | 8/1888 | Barnhart |
| 397,558 | A | 2/1889 | Lumley |
| 434,708 | A | 8/1890 | Grier |
| 475,020 | A | 5/1892 | Perry |
| 477,291 | A | 6/1892 | Bomar |
| 496,961 | A | 5/1893 | Trude |
| 527,273 | A | 10/1894 | Fowler |
| 536,272 | A | 3/1895 | Edsall |
| 543,935 | A | 8/1895 | Hostler |
| 612,061 | A | 10/1898 | Shambaugh |
| 613,231 | A | 11/1898 | Bennett |
| 618,425 | A | 1/1899 | Manger |

(Continued)

FOREIGN PATENT DOCUMENTS

FR 2549361 1/1985

OTHER PUBLICATIONS

Partial European Search Report for European Application No. EP 07008098, dated Mar. 28, 2011, in 9 pages.

(Continued)

*Primary Examiner* — Jonathan Liu
*Assistant Examiner* — Joshua Rodden
(74) *Attorney, Agent, or Firm* — Knobbe Martens Olson & Bear LLP

(57) ABSTRACT

A shelving system including an elongated support member and a plurality of shelves, each of which can be supported by a clamping mechanism. The support member has a telescoping configuration so that upper and lower ends of the support member can be pressed against upper and lower stationary objects. The clamping mechanism allows the plurality of shelves to be adjusted both vertically and laterally along a length of the elongated support member.

21 Claims, 22 Drawing Sheets

U.S. PATENT DOCUMENTS

| | | | | |
|---|---|---|---|---|
| 626,739 | A | | 6/1899 | Vanderman |
| 644,080 | A | | 2/1900 | Huebel |
| 839,339 | A | | 12/1906 | Tuttle |
| 845,917 | A | | 3/1907 | Worley |
| 913,955 | A | | 3/1909 | Hansen |
| 970,485 | A | | 9/1910 | Frey |
| 1,026,149 | A | | 5/1912 | Crane |
| 1,071,428 | A | | 8/1913 | Jones |
| 1,446,036 | A | | 2/1923 | Dodd |
| 1,478,339 | A | | 12/1923 | Jayne |
| 1,511,704 | A | | 10/1924 | Buck |
| 1,554,137 | A | | 9/1925 | Slifkin |
| 1,582,762 | A | | 4/1926 | Klock |
| 1,639,551 | A | | 8/1927 | Booth |
| 2,012,452 | A | | 8/1935 | Littell |
| 2,042,517 | A | | 6/1936 | Ellis |
| 2,199,851 | A | | 5/1940 | Freeman |
| 2,254,770 | A | | 9/1941 | Bitney |
| 2,513,889 | A | | 7/1950 | Nilsson |
| 2,677,519 | A | | 5/1954 | Hobson |
| 2,746,661 | A | | 5/1956 | Kaplan |
| 2,923,415 | A | | 2/1960 | Brown |
| 2,923,428 | A | | 2/1960 | Averill |
| 2,932,873 | A | | 4/1960 | Reichert |
| 2,936,146 | A | | 5/1960 | Wunder |
| 2,937,766 | A | | 5/1960 | Penn |
| 2,941,669 | A | | 6/1960 | Palay et al. |
| D188,332 | S | | 7/1960 | Salen |
| D189,722 | S | | 2/1961 | Wolf |
| 2,976,003 | A | | 3/1961 | Foster |
| 2,977,953 | A | | 4/1961 | Dowdy |
| 3,035,708 | A | | 5/1962 | Freeman |
| 3,043,440 | A | | 7/1962 | Berlin |
| 3,059,374 | A | | 10/1962 | Bernay |
| 3,088,598 | A | | 5/1963 | Werneke |
| D195,412 | S | | 6/1963 | Vernik |
| 3,111,723 | A | | 11/1963 | Bates |
| 3,115,107 | A | | 12/1963 | Glenny |
| 3,119,496 | A | | 1/1964 | Burk |
| 3,132,609 | A | | 5/1964 | Chesley |
| 3,138,260 | A | | 6/1964 | Tedrick |
| 3,181,923 | A | | 5/1965 | Gillon et al. |
| 3,266,764 | A | | 8/1966 | Briles |
| 3,307,710 | A | | 3/1967 | Negri |
| 3,319,983 | A | | 5/1967 | Zibell |
| 3,343,685 | A | | 9/1967 | Giambalvo |
| 3,471,031 | A | | 10/1969 | Coplan |
| 3,533,583 | A | * | 10/1970 | Azim ..... 248/125.2 |
| 3,593,857 | A | | 7/1971 | Hernes |
| D222,276 | S | | 10/1971 | Hughes, Jr. |
| 3,641,922 | A | | 2/1972 | Nachazel et al. |
| 3,695,455 | A | | 10/1972 | Larson |
| 3,787,078 | A | | 1/1974 | Williams |
| 3,789,996 | A | | 2/1974 | Stroh |
| 3,791,091 | A | | 2/1974 | Albrizzi |
| 3,807,574 | A | | 4/1974 | Lanza |
| 3,854,686 | A | * | 12/1974 | Konstant ..... 248/243 |
| 3,907,119 | A | | 9/1975 | Franz |
| 3,923,162 | A | | 12/1975 | Hussey |
| D239,579 | S | | 4/1976 | Taub |
| 3,954,182 | A | | 5/1976 | McEvers |
| 3,998,334 | A | | 12/1976 | Smith |
| 4,033,539 | A | | 7/1977 | Bardocz |
| 4,096,951 | A | | 6/1978 | Menssen |
| 4,106,736 | A | | 8/1978 | Becker et al. |
| 4,192,426 | A | | 3/1980 | Gauthier |
| 4,215,840 | A | | 8/1980 | Babberl |
| 4,232,790 | A | | 11/1980 | Serrano |
| 4,274,400 | A | | 6/1981 | Baus |
| 4,360,283 | A | | 11/1982 | Psotta |
| 4,387,811 | A | | 6/1983 | Ragir et al. |
| 4,415,091 | A | | 11/1983 | Wolff |
| 4,428,488 | A | | 1/1984 | McAvinn et al. |
| 4,437,450 | A | | 3/1984 | Connelly |
| D274,201 | S | | 6/1984 | Aaron |
| 4,511,047 | A | | 4/1985 | Elinsky |
| 4,541,131 | A | | 9/1985 | Sussman |
| 4,559,879 | A | | 12/1985 | Hausser |
| D286,599 | S | | 11/1986 | Sussman |
| D289,353 | S | | 4/1987 | Davis et al. |
| 4,664,428 | A | | 5/1987 | Bridges |
| 4,761,092 | A | | 8/1988 | Nakatani |
| 4,771,897 | A | | 9/1988 | Ho |
| 4,771,899 | A | | 9/1988 | Benedict et al. |
| 4,776,471 | A | | 10/1988 | Elkins |
| 4,786,022 | A | | 11/1988 | Grieshaber |
| 4,805,784 | A | | 2/1989 | Solheim et al. |
| 4,860,909 | A | | 8/1989 | Leumi |
| 4,865,283 | A | | 9/1989 | Parker |
| 4,869,378 | A | | 9/1989 | Miller |
| 4,895,331 | A | | 1/1990 | Nehls |
| 4,909,467 | A | | 3/1990 | Shan-Pao |
| D314,294 | S | | 2/1991 | Axhamre |
| 4,998,647 | A | | 3/1991 | Sharp |
| 5,014,860 | A | | 5/1991 | Emery |
| 5,023,755 | A | | 6/1991 | Rosenberg |
| 5,127,528 | A | | 7/1992 | Cone |
| 5,160,101 | A | | 11/1992 | Ferraro et al. |
| 5,180,067 | A | | 1/1993 | Conaway et al. |
| 5,192,427 | A | | 3/1993 | Eger et al. |
| 5,197,614 | A | | 3/1993 | Dalton et al. |
| 5,255,401 | A | | 10/1993 | Sambrookes et al. |
| 5,284,260 | A | | 2/1994 | Caligiuri, Sr. |
| 5,307,797 | A | | 5/1994 | Kleefeld |
| 5,318,175 | A | | 6/1994 | Stevens |
| D351,751 | S | | 10/1994 | Brightbill et al. |
| 5,355,867 | A | | 10/1994 | Hall et al. |
| 5,429,252 | A | | 7/1995 | Liu |
| 5,462,178 | A | | 10/1995 | Wallach et al. |
| 5,483,761 | A | | 1/1996 | Simpson |
| 5,505,318 | A | | 4/1996 | Goff |
| 5,524,772 | A | | 6/1996 | Simmons |
| 5,527,273 | A | | 6/1996 | Manna et al. |
| 5,588,543 | A | | 12/1996 | Finger |
| 5,632,049 | A | | 5/1997 | Chen |
| D382,733 | S | | 8/1997 | Goetz |
| 5,666,940 | A | | 9/1997 | Kreiter |
| 5,702,010 | A | | 12/1997 | Liang |
| D388,642 | S | | 1/1998 | Winter |
| 5,735,413 | A | | 4/1998 | Allen |
| 5,772,048 | A | | 6/1998 | Sopcisak |
| 5,772,050 | A | | 6/1998 | Shih |
| D396,379 | S | | 7/1998 | Stoetzl |
| D396,585 | S | | 8/1998 | Hofman |
| 5,833,192 | A | | 11/1998 | Buhrman |
| D402,145 | S | | 12/1998 | Hofman et al. |
| 5,855,286 | A | | 1/1999 | Zaid |
| 5,899,423 | A | | 5/1999 | Albertini |
| 5,934,636 | A | | 8/1999 | Cyrell |
| 5,941,397 | A | | 8/1999 | Buchanan et al. |
| 5,984,114 | A | | 11/1999 | Frankel |
| D417,991 | S | | 12/1999 | Hofman et al. |
| D419,020 | S | | 1/2000 | Emery et al. |
| 6,017,009 | A | | 1/2000 | Swartz et al. |
| D421,692 | S | | 3/2000 | Wojtowicz et al. |
| D421,867 | S | | 3/2000 | Carville et al. |
| D424,355 | S | | 5/2000 | Barton |
| 6,065,618 | A | | 5/2000 | Stetler |
| D427,469 | S | | 7/2000 | Thurston-Chartraw et al. |
| D429,934 | S | | 8/2000 | Hofman |
| 6,113,042 | A | | 9/2000 | Welsch et al. |
| 6,123,303 | A | | 9/2000 | Huang |
| 6,135,668 | A | | 10/2000 | Lin |
| 6,152,312 | A | | 11/2000 | Nava et al. |
| 6,206,206 | B1 | | 3/2001 | Saylor et al. |
| 6,233,877 | B1 | | 5/2001 | Monroe |
| D443,162 | S | | 6/2001 | Winter |
| D444,333 | S | | 7/2001 | Ferrer Beltran |
| D446,670 | S | | 8/2001 | Emery et al. |
| 6,302,280 | B1 | | 10/2001 | Bermes |
| 6,311,856 | B2 | | 11/2001 | Battaglia et al. |
| 6,318,572 | B1 | | 11/2001 | Lai |
| 6,347,777 | B1 | | 2/2002 | Webber et al. |
| 6,378,709 | B1 | | 4/2002 | Stuart |
| 6,394,404 | B1 | | 5/2002 | Cyrell |
| 6,409,029 | B1 | | 6/2002 | Bermes |
| D462,552 | S | | 9/2002 | Emery et al. |

6,481,586 B1 11/2002 Hoff
6,494,327 B2 12/2002 Huang
6,502,794 B1 1/2003 Ting
D470,703 S 2/2003 Hoernig
6,520,351 B1 2/2003 Zadro
6,527,473 B2 3/2003 Chen
D473,411 S 4/2003 Walker
6,540,430 B2 4/2003 Hsu
6,550,739 B1 4/2003 Brindisi
6,551,226 B1 4/2003 Webber et al.
D475,560 S 6/2003 Suero, Jr.
D475,561 S 6/2003 Suero, Jr.
6,575,315 B2 6/2003 Zidek
6,581,790 B1 6/2003 Zadro
6,591,996 B1 7/2003 Wu
6,619,164 B1 9/2003 Ricci et al.
6,648,152 B2 11/2003 Bermes
D483,251 S 12/2003 Suero, Jr.
6,688,238 B1 2/2004 Alexiou
6,726,034 B2 4/2004 Holbrook et al.
D489,207 S 5/2004 Rosen
D492,188 S 6/2004 Goldberg
6,758,355 B2 7/2004 Zidek
D493,991 S 8/2004 Dretzka
6,824,000 B2 11/2004 Samelson
6,824,225 B2 11/2004 Stiffler
6,848,144 B1 2/2005 McDonald
6,871,748 B2 3/2005 Suttles
6,918,498 B2 7/2005 Sparkowski
D509,361 S 9/2005 Suero, Jr.
6,957,794 B2 10/2005 Landreville et al.
D512,861 S 12/2005 Rosen
6,983,853 B1 1/2006 Ficket
D516,901 S 3/2006 Murray
7,021,814 B2 4/2006 Berardi
7,086,633 B2 8/2006 Welch et al.
D530,551 S 10/2006 Snell
D533,283 S 12/2006 Holztrager
D534,062 S 12/2006 Van den Bosch
7,195,213 B2 3/2007 Weatherly
D543,747 S 6/2007 Harwanko
D544,786 S 6/2007 Barrese
7,229,059 B1 6/2007 Hood
D546,879 S 7/2007 Qiu
7,246,711 B1 7/2007 Metcalf
D552,393 S 10/2007 Rosen
D564,257 S 3/2008 Yang et al.
7,347,197 B2 3/2008 Hankinson
D566,991 S 4/2008 Harwanko
D568,657 S 5/2008 Snider
D568,658 S 5/2008 Yang et al.
D569,148 S 5/2008 Yang et al.
D572,060 S 7/2008 Snider
D572,502 S 7/2008 Yang et al.
D572,516 S 7/2008 Snider
D573,386 S 7/2008 Clucas
D573,387 S 7/2008 Walker
D573,822 S 7/2008 Yang et al.
7,398,790 B2 7/2008 Glatz
7,401,754 B2 7/2008 Welch et al.
D574,649 S 8/2008 Snider
D574,650 S 8/2008 Snider
D578,815 S 10/2008 Dominique et al.
D587,504 S 3/2009 Russell et al.
D589,728 S 4/2009 Shaha et al.
D598,688 S 8/2009 Yang et al.
7,591,385 B2 9/2009 Brooks
D622,990 S 9/2010 Yang et al.
D628,841 S 12/2010 Yang et al.
2001/0004064 A1 6/2001 Battaglia et al.
2002/0158033 A1 10/2002 Chen
2002/0172549 A1 11/2002 Koros et al.
2003/0000905 A1 1/2003 Zidek
2003/0132181 A1 7/2003 Saulnier-Matteini
2003/0222191 A1 12/2003 Tsai
2004/0188577 A1 9/2004 Gaderick
2005/0040301 A1 2/2005 Walter
2005/0139562 A1 6/2005 Chen
2005/0205509 A1 9/2005 Flynn
2005/0205722 A1 9/2005 Krueger
2006/0180561 A1 8/2006 Wisnoski et al.
2006/0261022 A1 11/2006 Sampaio
2007/0045208 A1 3/2007 Quan
2007/0235611 A1 10/2007 Riblet
2007/0295681 A1 12/2007 Colin
2008/0000859 A1 1/2008 Yang et al.
2008/0035592 A1 2/2008 Yang et al.
2008/0053935 A1 3/2008 Newbouild et al.
2008/0142669 A1 6/2008 Zlotocha
2009/0134290 A1 5/2009 Begic et al.
2009/0188880 A1 7/2009 Yang et al.
2010/0133218 A1 6/2010 Yang et al.
2011/0271438 A1 11/2011 Yang et al.

OTHER PUBLICATIONS

U.S. Appl. No. 29/357,567, filed Mar. 12, 2010, Inventor Yang et al.
U.S. Appl. No. 29/357,568, filed Mar. 12, 2010, Inventor Yang et al.

* cited by examiner

SHELVING SYSTEM

PRIORITY INFORMATION

This application is a Continuation of U.S. patent application Ser. No. 11/670,391, filed on Feb. 1, 2007, which is a Continuation-in-Part of U.S. patent application Ser. No. 11/477,755 filed on Jun. 29, 2006, the entire contents of each of which is hereby expressly incorporated by reference herein.

BACKGROUND OF THE INVENTIONS

1. Field of the Inventions

The present inventions are directed to devices that can be used for organizing personal articles, for example, to shelving systems having adjustable shelves.

2. Description of the Related Art

Shelving devices, such as those commonly known as "shower caddies", are often used in a shower or bath enclosure to store and organize personal care articles, such as shampoo, soap, razors, toothbrushes, bath sponges, etc. Shower caddies typically include shelves or baskets for holding the personal care items.

Such shower caddies are sometimes secured to a shower wall with suction cups or simply hung on a shower head pipe to avoid damaging the shower wall. Shower caddies having suction cups typically have suction cups in fixed positions. Sometimes the suction cups must be positioned over a grout line or another type of break in the shower wall and are therefore not securely attaching the shower caddy to the shower wall. Furthermore, the suction cups may not provide a secure enough attachment for the shower caddy to hold heavy items, such as large bottles of toiletries.

SUMMARY OF THE INVENTIONS

In accordance with an embodiment, a shelving system can comprise at least one elongated support member configured to be positionable in an orientation such that it is elongated in a generally vertical direction. The at least one elongated support member can also comprise at least first and second channels extending along lateral edges of the support member. At least one member can be configured to support an article for drying. A connecting mechanism can be configured to releasably connect the at least one member to the elongated support member. The connecting mechanism can further comprise first and second engaging members, each of the first and second engaging members can be pivotally mounted relative to the at least one elongated support member and comprising a control portion and an engaging portion. Each of the engaging portions can be configured to extend into one of the first and second channels. The connecting mechanism can further comprise a biasing device configured to bias the first and second engaging members toward a position in which the engaging portions extend into the first and second vertical channels. At least one of the biasing member and the engaging portions can be configured to engage the first and second vertical channels with sufficient force to support the at least one member with at least one wet article supported by the at least one member.

In accordance with another embodiment, a drying rack can comprise at least one member configured to support an article for drying. A connecting mechanism can be configured to releasably connect the at least one member to an elongated vertical support member having first and second elongated vertical channels. The connecting mechanism can further comprise first and second engaging members. Each of the first and second engaging members can be pivotally mounted relative to the at least one member and can comprise a control portion and an engaging portion. Each of the engaging portions can be configured to extend into one of the first and second elongated vertical channels. The connecting mechanism can further comprise a biasing device configured to bias the first and second engaging members toward a position in which the engaging portions extend into the first and second vertical channels. Additionally, at least one of the biasing member and the engaging portions can be configured to engage the first and second vertical channels with sufficient force to support the at least one member with at least one wet article supported by the at least one member.

An aspect of at least one of the embodiments disclosed herein includes the realization that mounting a shelf so as to be adjustable both in generally vertical and lateral directions can provide advantages. For example, with regard to shelving systems known as "shower caddies", users can encounter difficulties associated with over-sized bottles of shampoo and/or other toiletries. Such over-sized shampoo bottles are often sold through warehouse-type retail stores that offer larger-sized containers of products such as shampoo. These larger than normal sized bottles can be difficult to fit into some shower caddies. Additionally, such over-sized items can cause similar difficulties with other types of shelving systems as well. Thus, by configuring a shelving system to allow a shelf to be adjustable in both the generally vertically and generally lateral directions, the shelves can be adjusted to accommodate a variety of differently sized items.

Thus, in accordance with an embodiment, a shelving system can comprise a support member having a first end, a second end, and a longitudinal axis. At least one shelf can be slidably connected to the support member with a connection mechanism. The connection mechanism can be configured to allow the at least one shelf to be adjusted in a first direction generally parallel to the longitudinal axis and in a second direction substantially perpendicular to the longitudinal axis with respect to the support member.

Another aspect of at least one of the embodiments disclosed herein includes the realization that shelving systems that include suctions cups, such as some known shower caddies, can present difficulties in placement of the suction cup. For example, some known shower caddies have suction cups in fixed positions relative to the shelves. However, under some orientations with the main body of the shower caddie aligned as the user desires, the suction cups might be aligned with a grout line or other irregularity in the surface to which the suction cup is to be attached. Thus, the suction cup might not achieve a good seal if it is pressed against the grout line or irregularity.

Thus, in accordance with another embodiment, a shelving system for a shower can comprise a central portion having a top end and a bottom end, wherein the central portion comprises at least one shelf. An upper attachment device can be configured to hang the central portion within a shower. Additionally, a lower attachment device can be connected to the bottom end, wherein the lower attachment device is configured to be adjustable in at least a generally horizontal direction.

In accordance with another embodiment, a shower organizer can comprise an elongated element having a longitudinal axis, a first end, and a second end. A connector can define an aperture configured to fit around a shower head pipe. At least one shelf can be mounted on the elongated element. Additionally, a resilient member can be disposed in the aperture so as to lie between an outer surface of a shower head pipe and an inner surface of the aperture when the connector is disposed around a shower head pipe.

In accordance with yet another embodiment, a shower caddy can comprise an elongated central support member defining a longitudinal axis. The central support member can have an I-shaped cross section comprising at least a first flange with first and second lateral edges. At least first and second shelves can also be provided, wherein each of the first and second shelves can have at least first and second cross members extending generally laterally across the respective shelves. At least first and second clamp mechanisms can releasably connect the first and second shelves, respectively, to the central support member, and each of the first and second clamp mechanisms can comprise a clamp body defining first and second hooks configured to engage the first and second lateral edges of the first flange, a clamp plate disposed at least partially in the clamp body and configured to rest against the first and second cross members, and a lever member having a cam. The lever member can be configured to pivot between locked and unlocked positions, wherein in the locked position, the cam presses the clamp plate against the cross members and causes the first and second hooks to press against the first and second lateral edges, respectively, with sufficient force to support the weight of the shelf. A first connector device can be disposed at an upper end of the central support member. The first connector can have a first portion fixed to the upper end of the support and a second portion pivotally connected to the first portion so as to be pivotable between open and closed positions. The first and second portions can define an aperture configured to fit around a shower head pipe when in the closed position. Additionally, a second connector device can comprising a suction cup pivotally mounted to a lower end of the central support member so as to be pivotable about a pivot axis extending generally perpendicular to the longitudinal axis.

BRIEF DESCRIPTION OF THE DRAWINGS

These and other features and advantages of the present embodiments will become more apparent upon reading the following detailed description and with reference to the accompanying drawings of the embodiments, in which.

DETAILED DESCRIPTION OF THE PREFERRED EMBODIMENT

An improved shelving system 10 is disclosed herein. The embodiments disclosed herein are described in the context of a shower caddy because the embodiments disclosed herein have particular utility in this context. However, the embodiments and inventions herein can also be applied to types of shelving units configured for other types of environments.

With reference to FIGS. 1-10, the shower caddy 10 can have a support member 12 configured to support at least one shelf 16. In some embodiments, the support member 12 can be in the form of an elongated member. Further, in some embodiment, the support member 12 can be an I-beam. However, other configurations can also be used.

Figure 2:
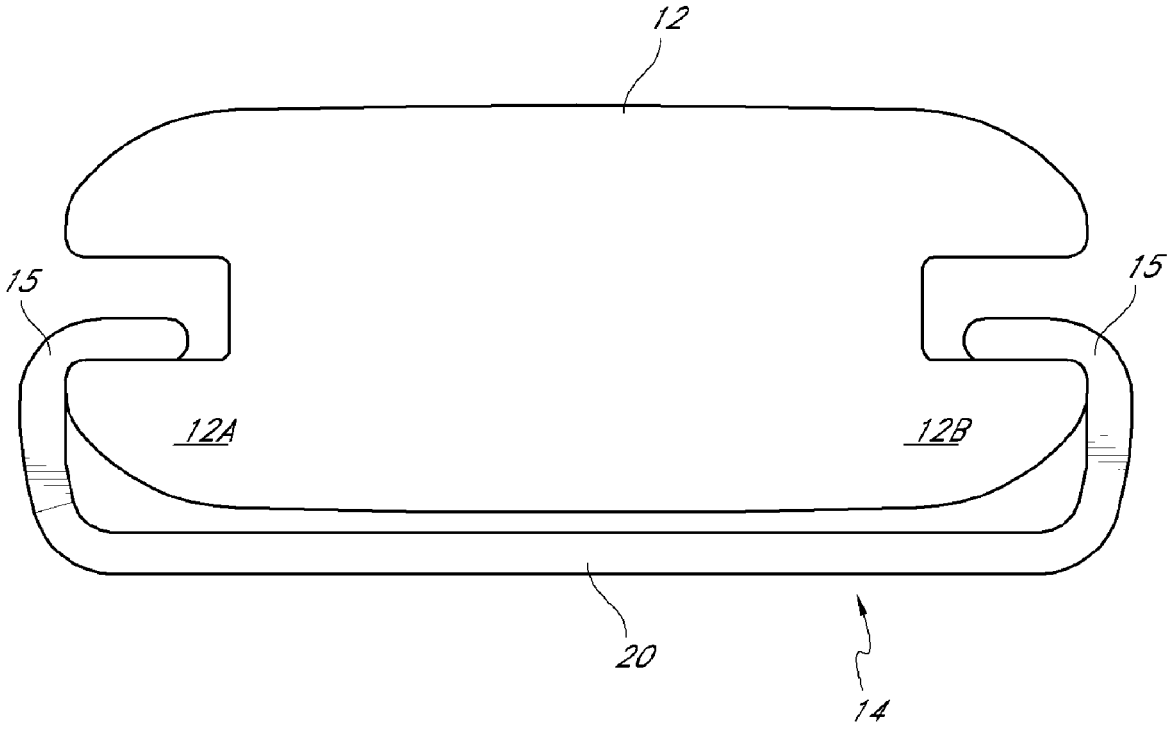
FIG. 2 is a schematic cross-sectional view of a portion of the central support member and a portion of a clamp that can be used to secure a shelf to the central support member.

FIG. 2 is a cross-sectional view of a portion of the support member 12 and a portion of a clamping mechanism 14 for securing a shelf 16 on the support member 12. As shown in FIG. 2, the cross-sectional shape of the support member 12 can be in the shape of the letter "I." In some embodiments, the support member 12 can be formed of satin aluminum that is bead blasted with clear anodizing. The skilled artisan will understand that the support member 12, however, may be constructed of other suitable materials, including, but not limited to, steel, stainless steel, or any other metal, plastics, wood, or any other material.

Although the illustrated embodiment of the shower caddy 10 has three shelves 16, the skilled artisan will understand that the shower caddy 10 may have only one shelf or as many shelves as will fit on the shower caddy 10. Furthermore, although the shower caddy 10 in the illustrated embodiment has shelves 16 having certain configurations, the skilled artisan will appreciate that the shelves 16 may have different configurations.

As will be described in more detail below, the clamping mechanism 14 can be configured to allow a user to adjust a position of the shelf 16 in addition to holding it in place on the support member 12. In some embodiments, the shelf 16 can be adjusted both in the horizontal and vertical directions. This provides additional advantages in that the shelves can be positioned to accommodate other devices or appliances that may be in a user's shower, as well as various sizes of items, such as toiletries, that may be oversized.

The clamping mechanism 14 can be slidably mounted on the support member 12 in the vertical or longitudinal direction. As shown in FIG. 2, the clamping mechanism 14 can have a hook 15 on both lateral sides that is configured to fit around and engage the outer flanges 12A, 12B of the column 12. As described in more detail below, the shelf 16 can be adjusted, in both the horizontal and vertical directions, when the clamping mechanism 14 is loosened. When the clamping mechanism 14 is tightened, the shelf 16 is secured to the support member 12 in a fixed position. Thus, the clamping mechanism 14 can be configured to hold the shelf 16 in place when the shelf is loaded with the maximum design weight, and in wet environments, such as a shower.

The terms of orientation, as used herein, such as "top," "bottom," "horizontal," "vertical," "longitudinal," "lateral," and "end" are used in the context of the illustrated embodiment. Because other orientations are possible, however, the present invention should not be limited to the illustrated orientation. The skilled artisan will appreciate that other orientations are also possible.

Figure 3:
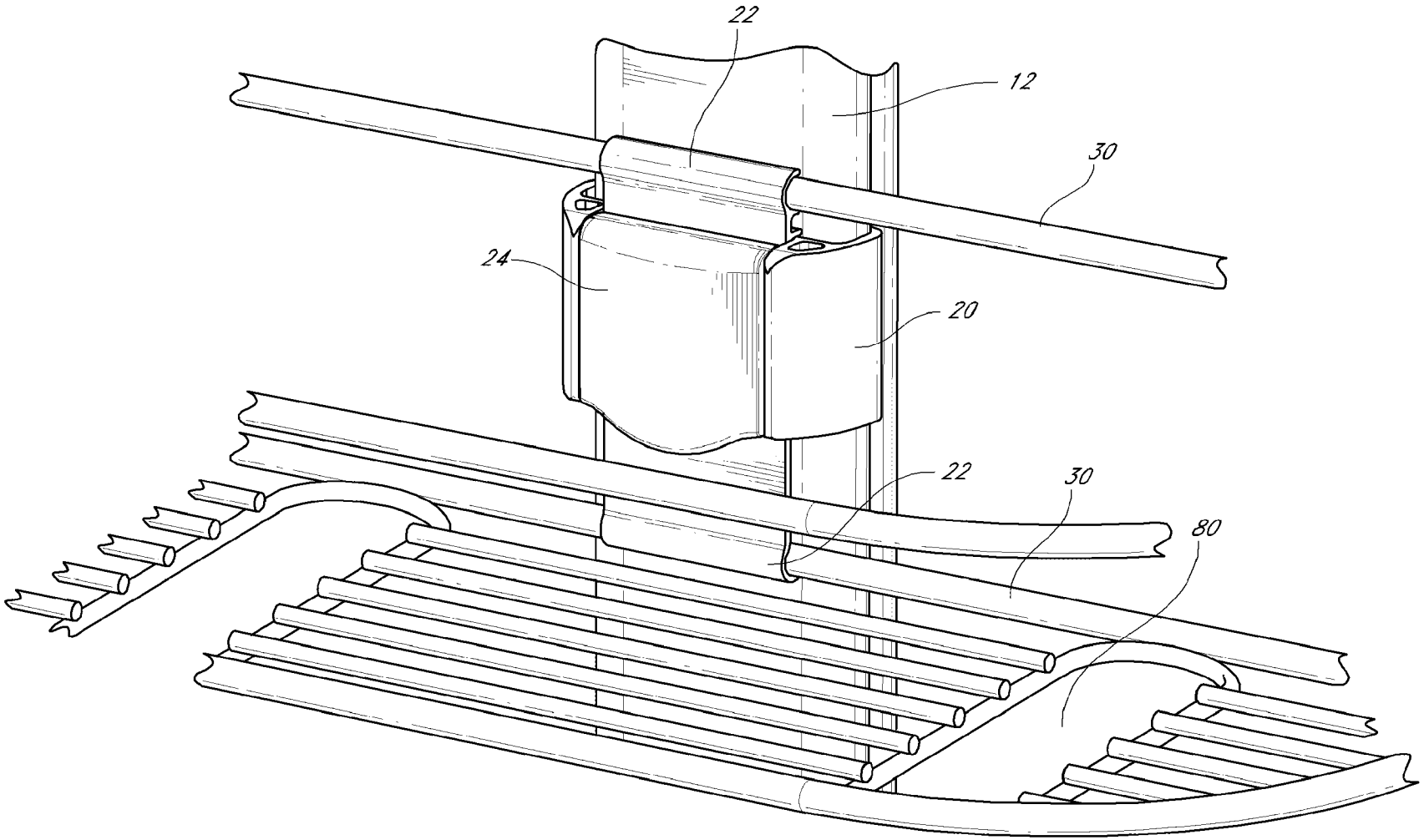
FIG. 3 is an enlarged front, top, and left side perspective view of a portion of a shelf and a clamping mechanism of the shower caddy.
Figure 4A:
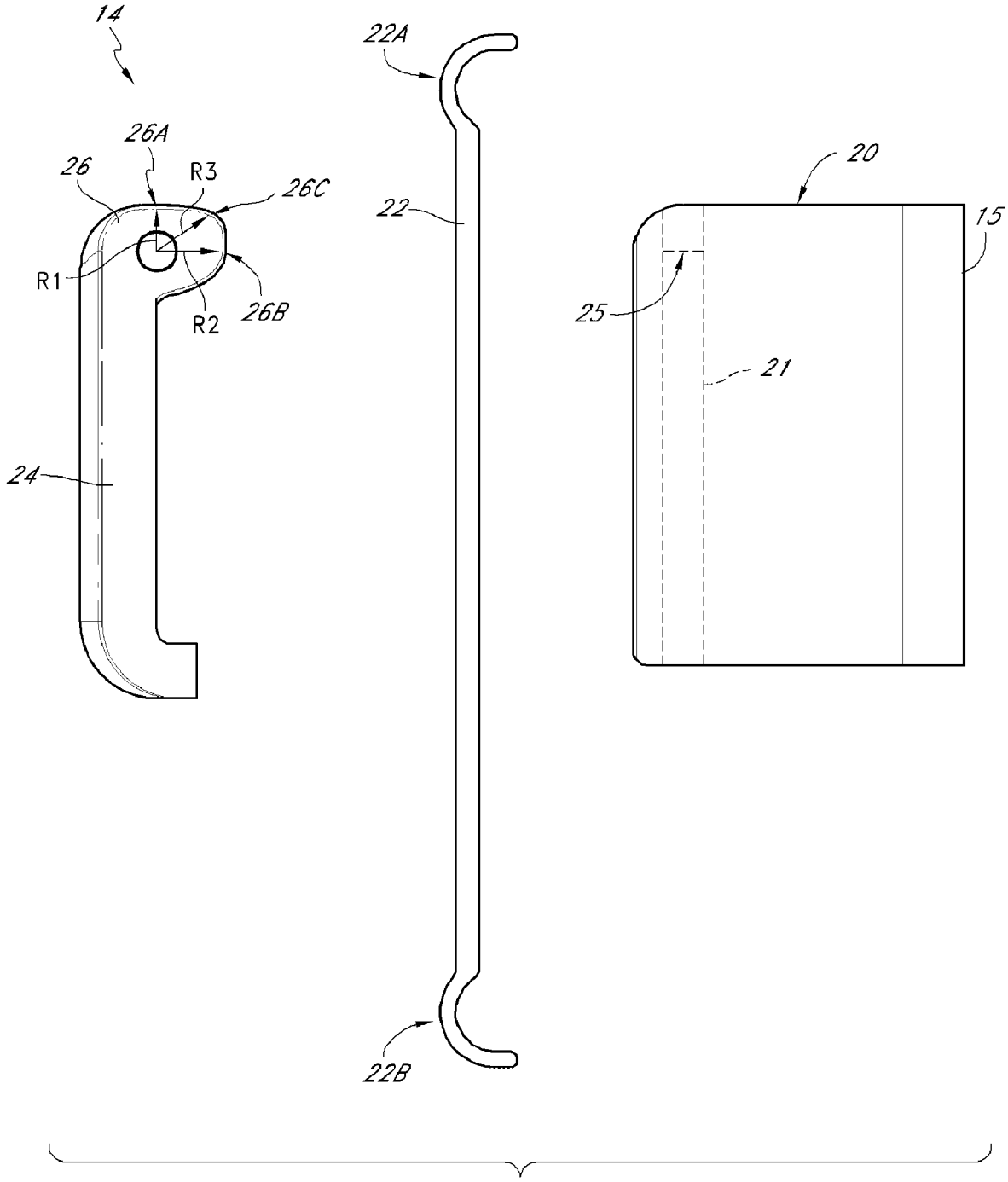
FIG. 4*a* is an exploded schematic side view of the clamping mechanism.
Figure 4B:
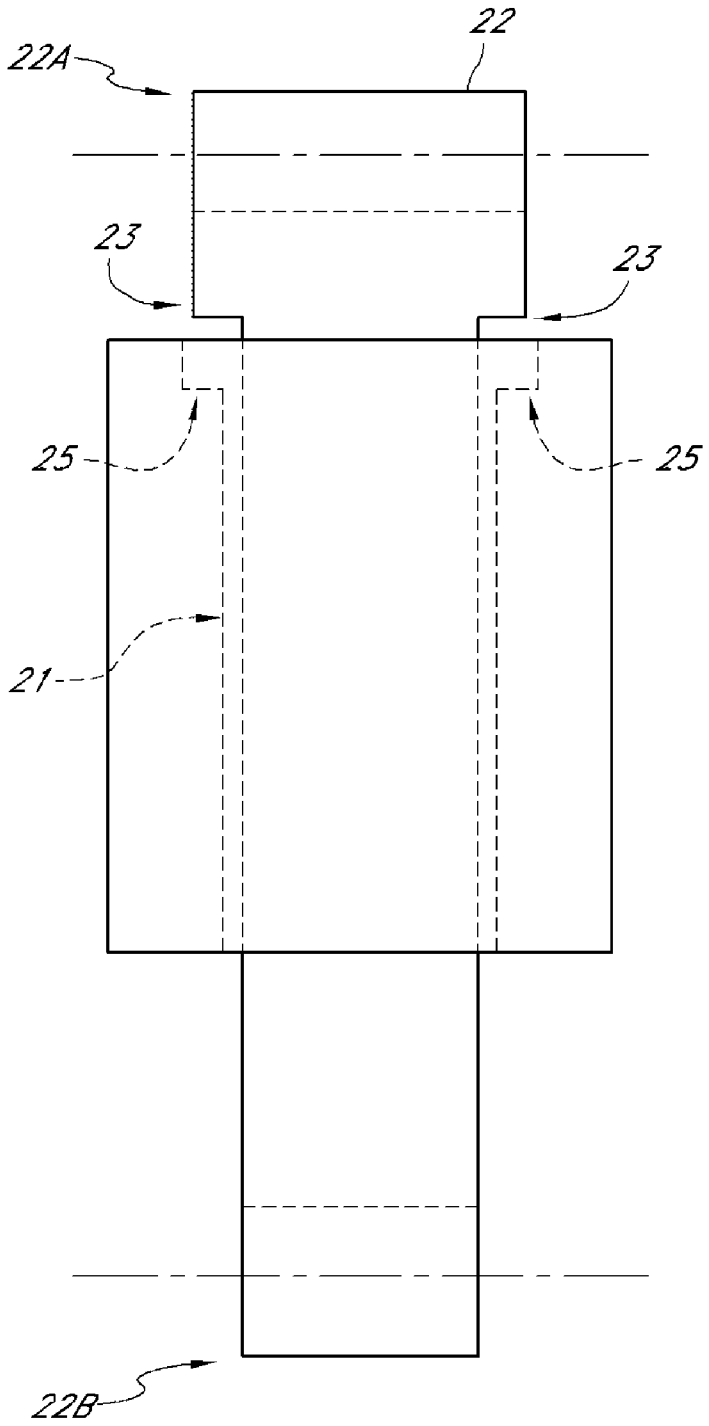
FIG. 4*b* is an exploded schematic front elevational view of the clamping mechanism

With reference to FIGS. 3-5 the clamping mechanism 14 can include a clamp body 20, clamp plate 22, and clamp lever 24, however, other configurations can also be used. The clamp body 20 can have hooks 15 on both sides, as noted above, that are configured to hook around and engage the outer flanges 12A, 12B of the support member 12, as shown in FIGS. 2 and 3. Additionally, the clamp body can include a slot 21 configured to receive the clamp plate 22. In some embodiments, the slot 21 can be configured to support the clamp plate 22 within the slot, described in greater detail below with reference to FIG. 4*b*.

The clamp plate 22 can be a generally flat member that is configured to fit through the slot 21 in the clamp body 20, although other configurations can also be used. As shown in FIGS. 3-5*c*, the clamp plate 22 can be configured to engage at least one cross member 30 of the shelf 16. For example, the clamp plate 22 can have upper and lower shoulders 22A, 22B or rounded portions that are shaped to engage cross members 30 of the shelf 16 when the clamping mechanism 14 is in the "closed" position (as explained in more detail below).

In some embodiments, the clamp plate 22 can be configured to engage the slot 21 so as to prevent the clamp plate 22 from falling through the slot 21, for example, when the clamp mechanism 14 is open. For example, with reference to FIG. 4*b*, the clamp plate 22 can include at least one shoulder configured to rest against a corresponding shoulder in or around the slot 21.

In some embodiments, the plate 22 can include shoulders 23. The shoulders 23 can be arranged to protrude outwardly from the main portion of the clamp plate 22. Additionally, the clamp body 20 an include shoulders 25 configured to rest against the shoulders 23 so as to prevent the clamp plate 22 from falling through the clamp body 20. However, other configurations can also be used.

Figure 5A:
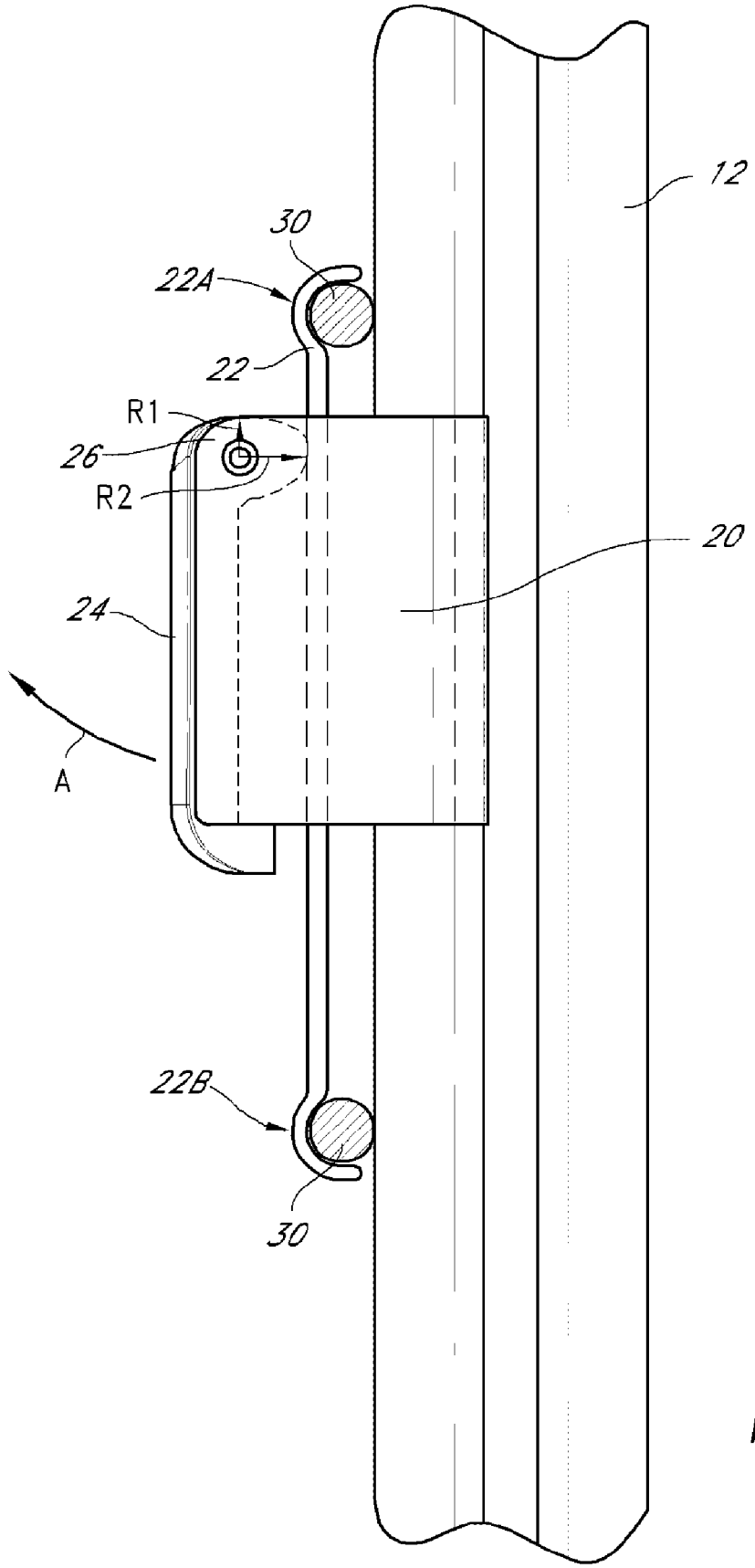
FIG. 5*a* is a schematic side elevational and partial cross-sectional view of the central support member, clamping mechanism, and a shelf of the shower caddy, with the clamping mechanism being shown in a "closed" position.
Figure 5B:
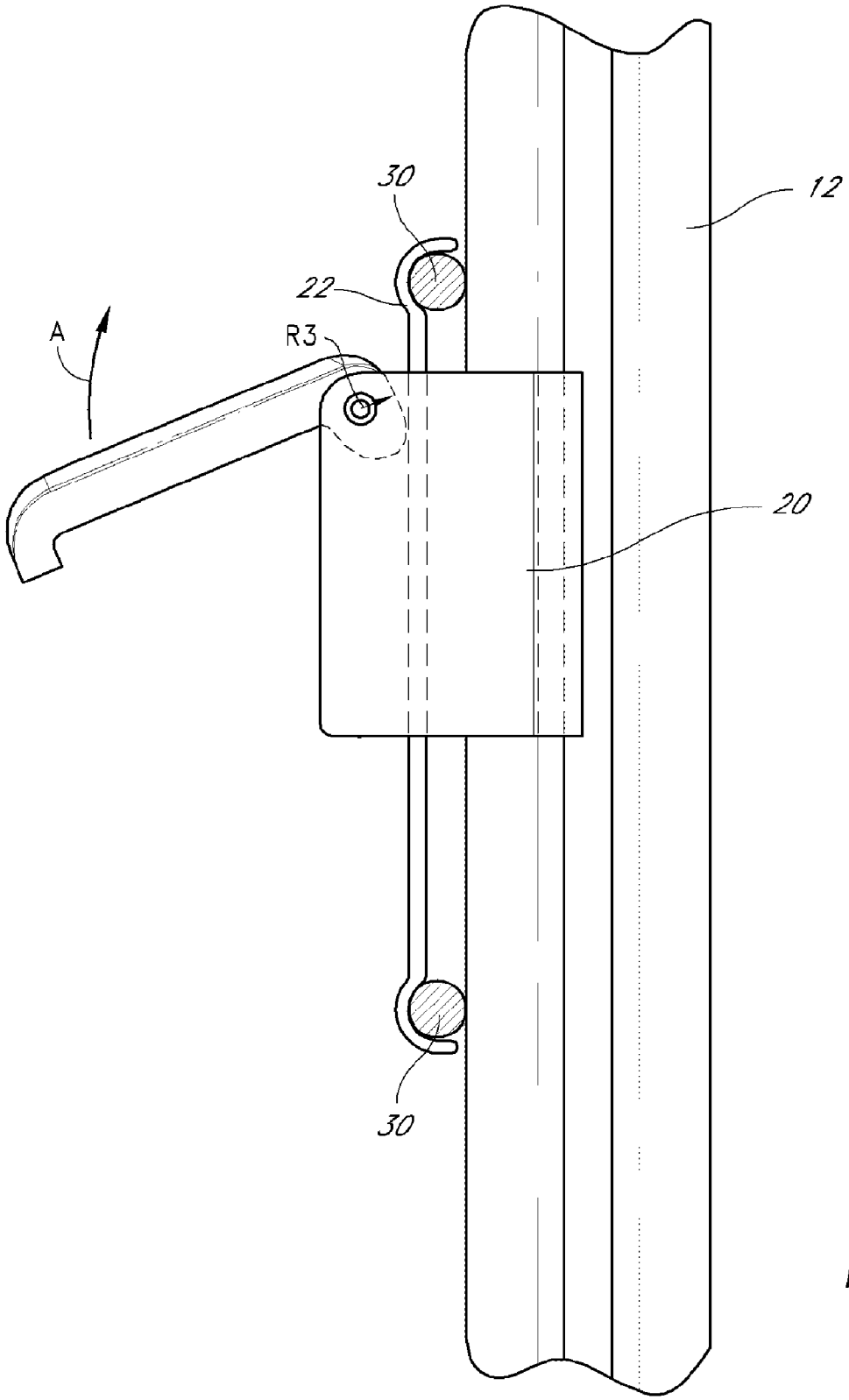
FIG. 5*b* is a side cross-sectional view of the vertical column, clamping mechanism, and shelf of the shower caddy, with the clamping mechanism in an intermediate position between closed and open positions.

As shown in FIGS. 3 and 5*a*-5*b*, a lever 24 can be rotatably mounted relative to the clamp body 20. The lever 24 can be configured to move between open (or unlocked) and closed (or locked). For example, the lever 24 can be configured to secure the shelf 16 to the support member 12 when the lever 24 is in the closed position and to allow the shelf 16 to be moved when the lever 24 is in the open position. In some embodiments, the clamp lever 24 can be formed of a translucent polycarbonate. However the skilled artisan will appreciate that the lever 24 may be formed of other suitable materials, including, but not limited to, steel, stainless steel, aluminum, plastics, or any other material In some embodiments, the lever 24 can include a cam 26 configured to convert the pivotal movement of the lever 24 into a translational movement of the clamp plate 22. For example, the lever 24 can be hinged or otherwise pivotally mounted relative to the clamp body 20, as shown in FIGS. 5*a* and 5*b*. As noted above, the lever 24 includes a cam 26. In some embodiments, the cam 26 can include at least a first portion 26*a* having a radius R1 and a second portion 26*b* with a radius R2, R2 being larger than R1. As such, when the lever 24 is rotated such that the first portion 26*a* is juxtaposed to the clamp plate 22, the clamp device 14 is in the open position. Additionally, when the lever 24 is rotated such that the second portion 26*b* is juxtaposed to the clamp plate 22, the clamp device 14 is in the closed position. These movements are described below in greater detail with reference to FIGS. 5*a*-5*c*.

Optionally, the cam 26 can include a third portion 26*c* having a radius R3 which is larger than radius R2. As such, the cam 26 can be configured to provide an "over-center" operation. For example, with the radius R3 being larger than both the radiuses R1 and R2, the cam 26 will generate a maximum pressing force against the clamp plate 22 when the third portion 26*c* is juxtaposed to the clamp plate 22. However, as is described below in greater detail, this pressing force is reduced as the lever 24 is further pivoted until the second portion 26*b* is juxtaposed to the clamp plate 22. This provides an advantage in that the user is provided with a tactile signal that the lever 24 has been moved to the fully closed position. Additionally, the lever 24 will move quickly from the intermediate position in which the third portion 26*c* is juxtaposed to the clamp plate 22 to the fully closed position in which the second portion 26*b* is juxtaposed to the clamp plate 22.

FIG. 5*a* shows the lever 24 in the "closed" position, which is when the clamping mechanism 14 is tightened to hold the shelf 16 in place. In this "closed" position, the clamping mechanism 14 is secured to the support member 12 by the pressing force caused by the second portion 26*b* of the cam 26 pushing against the clamp plate 22, which, in turn, pushes the clamp plate 22 against an outer surface of the support member 12. This pressing force also causes the hooks 15 (FIG. 2) of the clamp body 20 to press against and tighten around the flanges 12A, 12B (FIG. 2) of the support member 12. In the "closed" position, the shoulders of the clamp plate 22 engage the cross members 30 of the shelf, as shown in FIG. 5*a*, and thus press the cross members 30 against the outer face of the support member 12.

The pressure between the shoulders 22A, 22B of the clamp plate 22 and the cross members 30 as well as the pressure between the hooks 15 of the clamp body 20 and the outer flanges 12A, 12B of the support member 12 secure the shelf 16 in place in both the horizontal and vertical directions. As such, the magnitude of the radius R2 can be determined so as to provide a sufficient pressing force against the clamp plate 22 such that the friction between at least one of the cross members 30, the outer surface of the support member 12, the inner surface of the flanges 12A, 12B, and the hooks 15 is sufficient to support the shelf 16 at the desired location under a maximum load. However, other devices can also be used to secure the shelves 16.

Figure 5C:
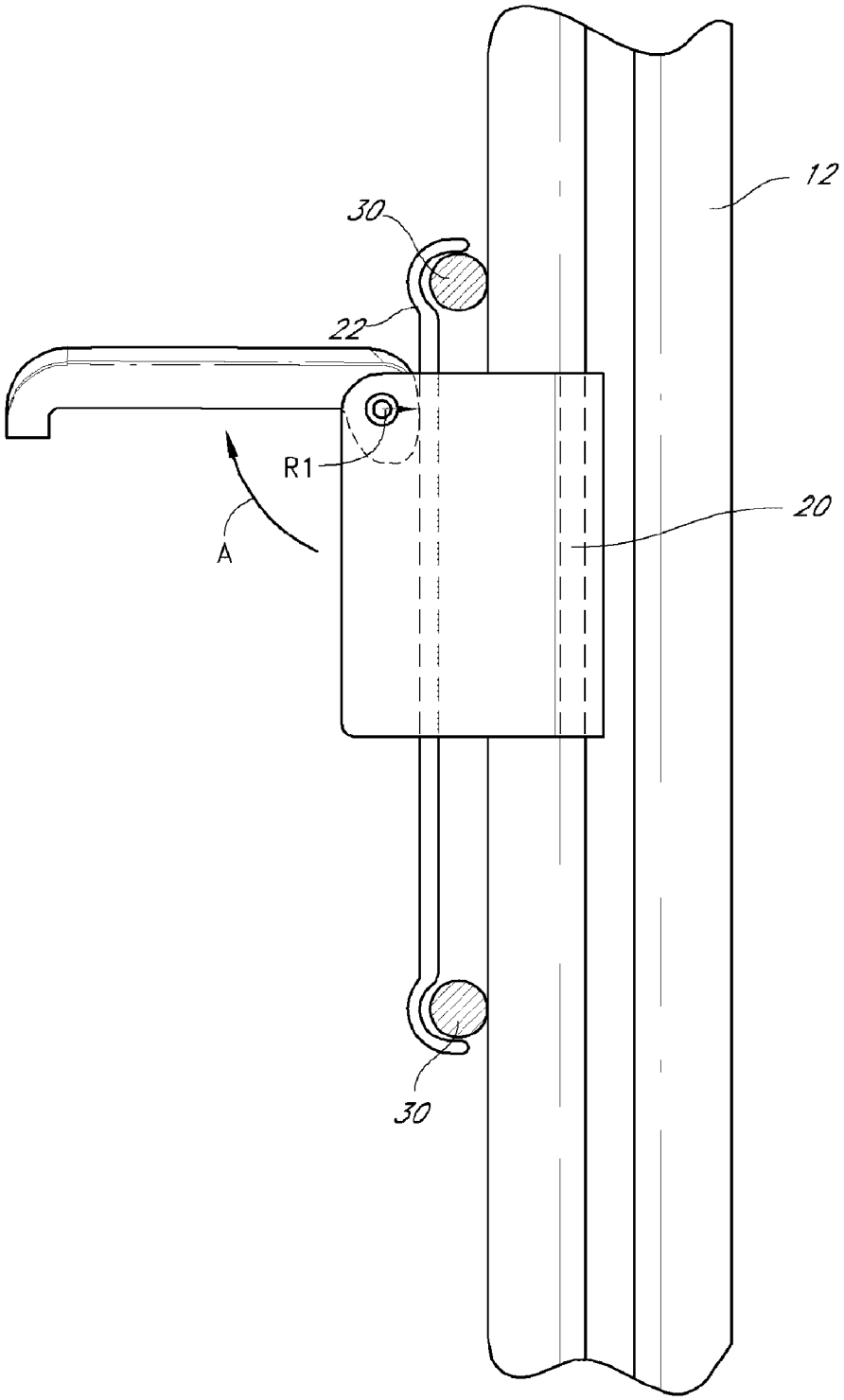
FIG. 5*c* is a side cross-sectional view of the vertical column, clamping mechanism, and shelf of the shower caddy, with the clamping mechanism in the "open" position.

When the lever 24 is in the "open" position, as shown in FIG. 5*c*, the first portion 26*a*, having the radius R1, is juxtaposed to the clamp plate 22. In some embodiments, the magnitude of the radius R1 is sufficiently small that the shelf 16 can be adjusted, both vertically and horizontally when the lever 24 is in this position.

The skilled artisan will understand that a user may "open" the lever 24 by pulling it generally in the direction of arrow A, away from the clamp plate 22 and the column 12. When the lever 24 is pulled in this direction, the cam 26 rotates in a clockwise direction (as viewed in FIG. 5*b*) and thus pulls away from the clamp plate 22 as the first portion 26*a* is moved into juxtaposition with the clamp plate 22. When the cam 26 is pulled away from the clamp plate 22, the tension is reduced and the shelf 16 may be adjusted by a user both vertically and horizontally.

This arrangement provides additional advantages. For example, with reference to FIG. 5*d*, the upper most shelf 16 is illustrated in its centered position, i.e., where the geometric center of the shelf is aligned with the longitudinal axis of the support member 12. By configuring the shelving system to allow the shelves to be adjusted laterally, the shelves can be rearranged to accommodate differing sizes of articles.

Figure 5D:
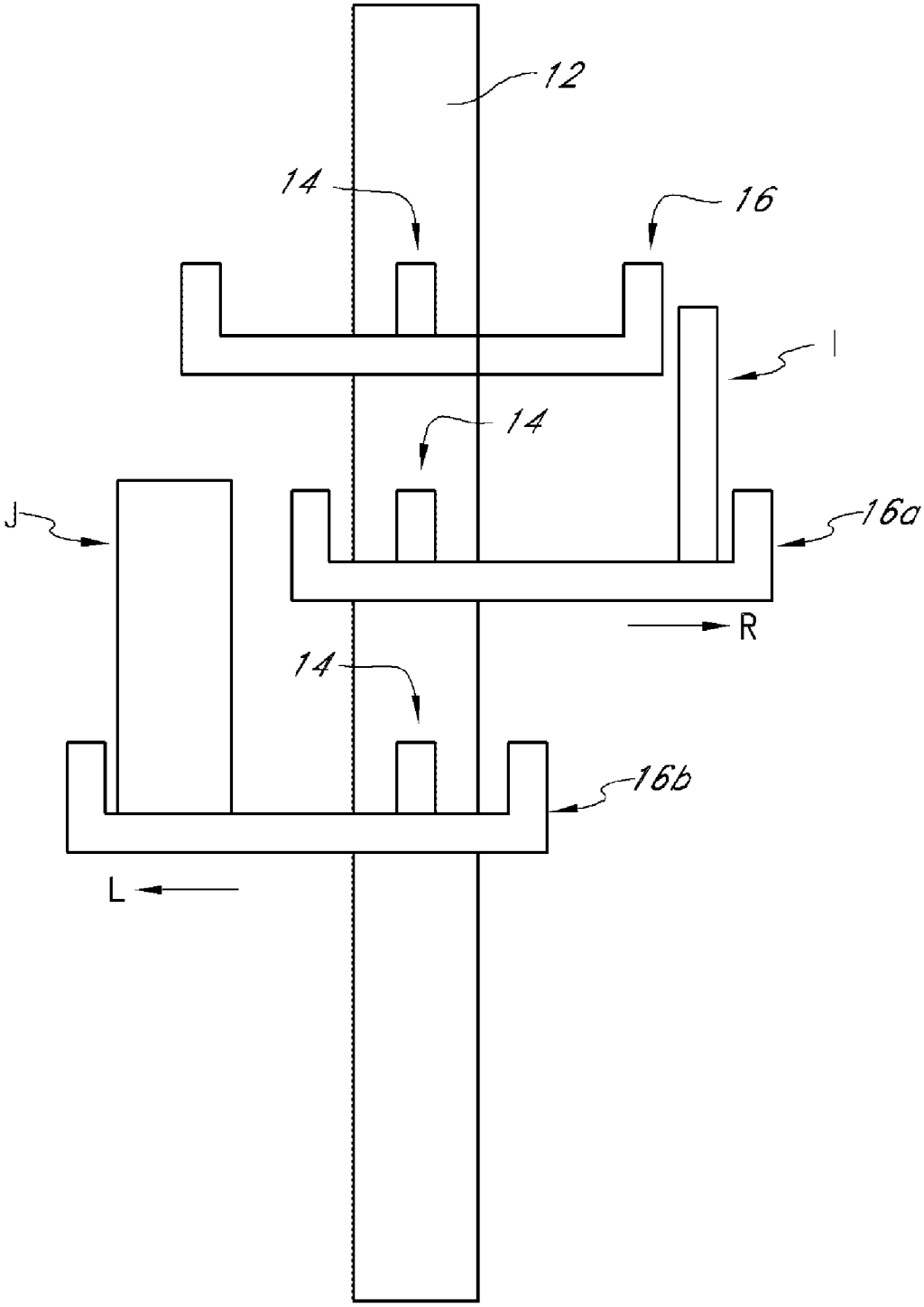
FIG. 5*d* is a schematic front elevational view of the shelving system in which two of the shelves have been adjusted laterally away from their centered position.

For example, with continued reference to FIG. 5*d*, the shelf below the upper most shelf, identified generally as shelf 16*a*, has been laterally adjusted towards the right hand side of the figure, i.e., in the direction of arrow R. In this configuration, a tall item I can be placed on shelf 16*a* without impacting the upper most shelf 16. Such tall items can be, for example, but without limitation, large shampoo bottles commonly sold in discount warehouse retail stores.

Additionally, when adjacent shelves are shifted in opposite directions, an even larger space can be provided. For example, as shown in FIG. 5*d*, the shelf 16*b* which is below the shelf 16*a*, has been adjusted toward the left hand side of the figure, i.e., in the direction of arrow L. In such a configuration, an even larger tall item J can be supported on the shelf 16*b* without impacting the shelf 16*a* above the shelf 16*b*.

In operation, to adjust a shelf 16 in the lateral direction, a user can pivot the lever 24 toward the open position (FIG. 5*c*), thereby reducing pressure on the clamp plate 22, which in turn, reduces the pressure between the cross wires 30 and the outer face of the support member 12 and as well as the pressure between the hooks 15 and the flanges 12A, 12B (FIG. 2). With the lever positioned as such, a user can slide the shelves 16 relative to the clamping mechanism 14.

Figure 7:
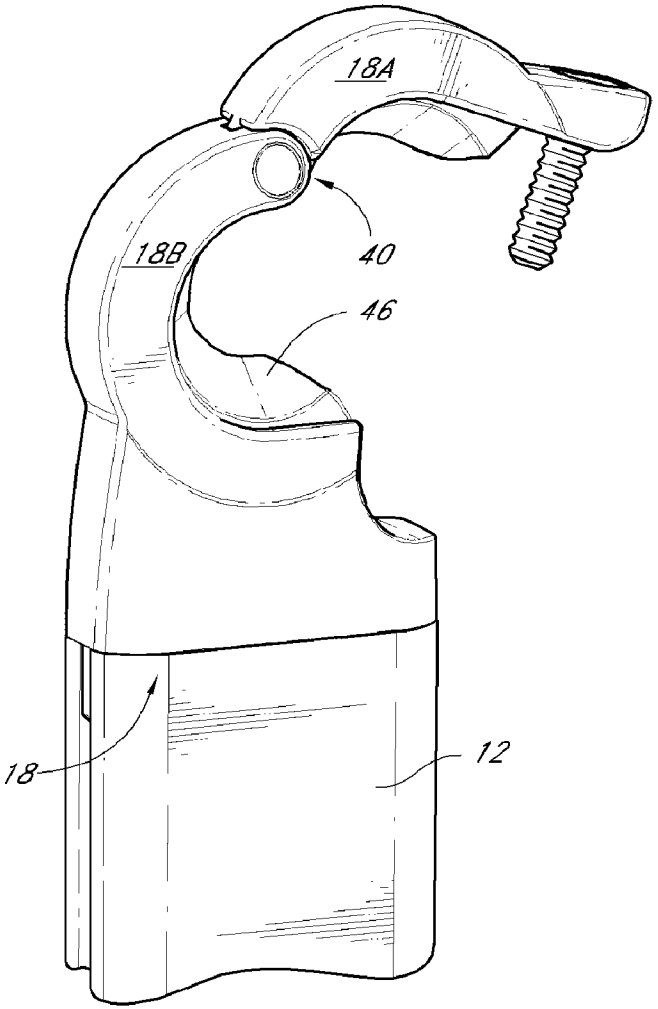
FIG. 7 is a front, top, and right side perspective view of the upper attachment device shown in an "open" position.
Figure 6:
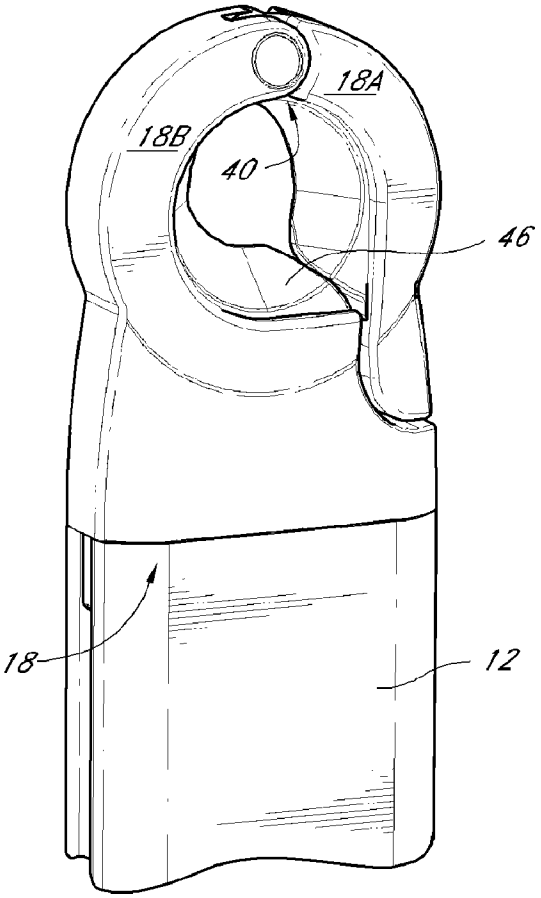
FIG. 6 is a front, top, and right side perspective view of an upper attachment device that can be used with the shower caddy shown in a "closed" position.
Figure 8:
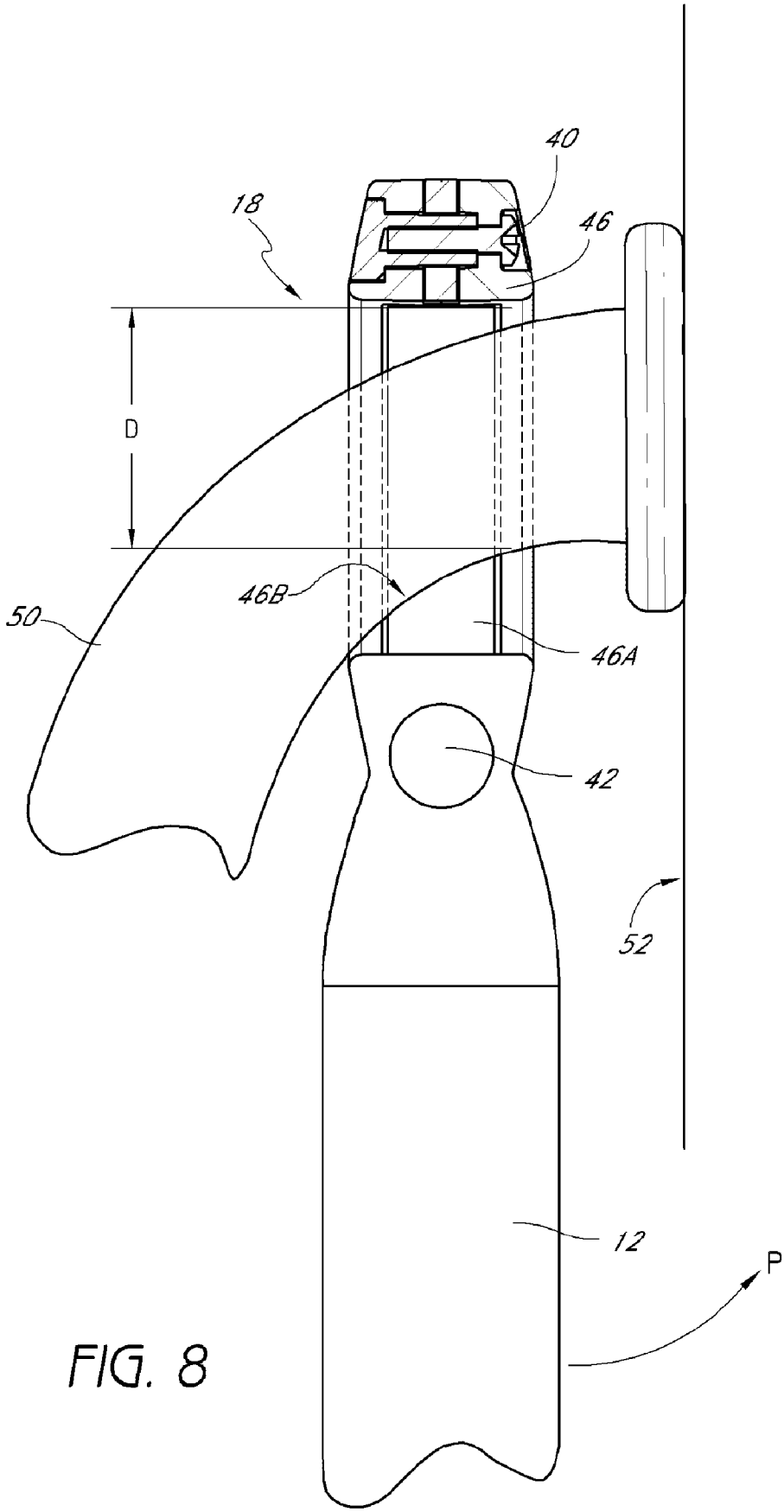
FIG. 8 is a schematic side cross-sectional view of the upper attachment device positioned on a shower head pipe.

With reference to FIGS. 6-8, the shower caddy 10, can be fitted with an openable loop mechanism 18 at the top of the support member 12. The openable loop mechanism 18 can be configured to support the weight of the shower caddy 10 from a shower head (not shown) or a pipe 50 leading to a shower head. For example, the openable loop mechanism 18 can be fitted onto the pipe 50, when it is in an open position (FIG. 7), then closed to secure it in place, as shown in FIG. 8.

Figure 1:
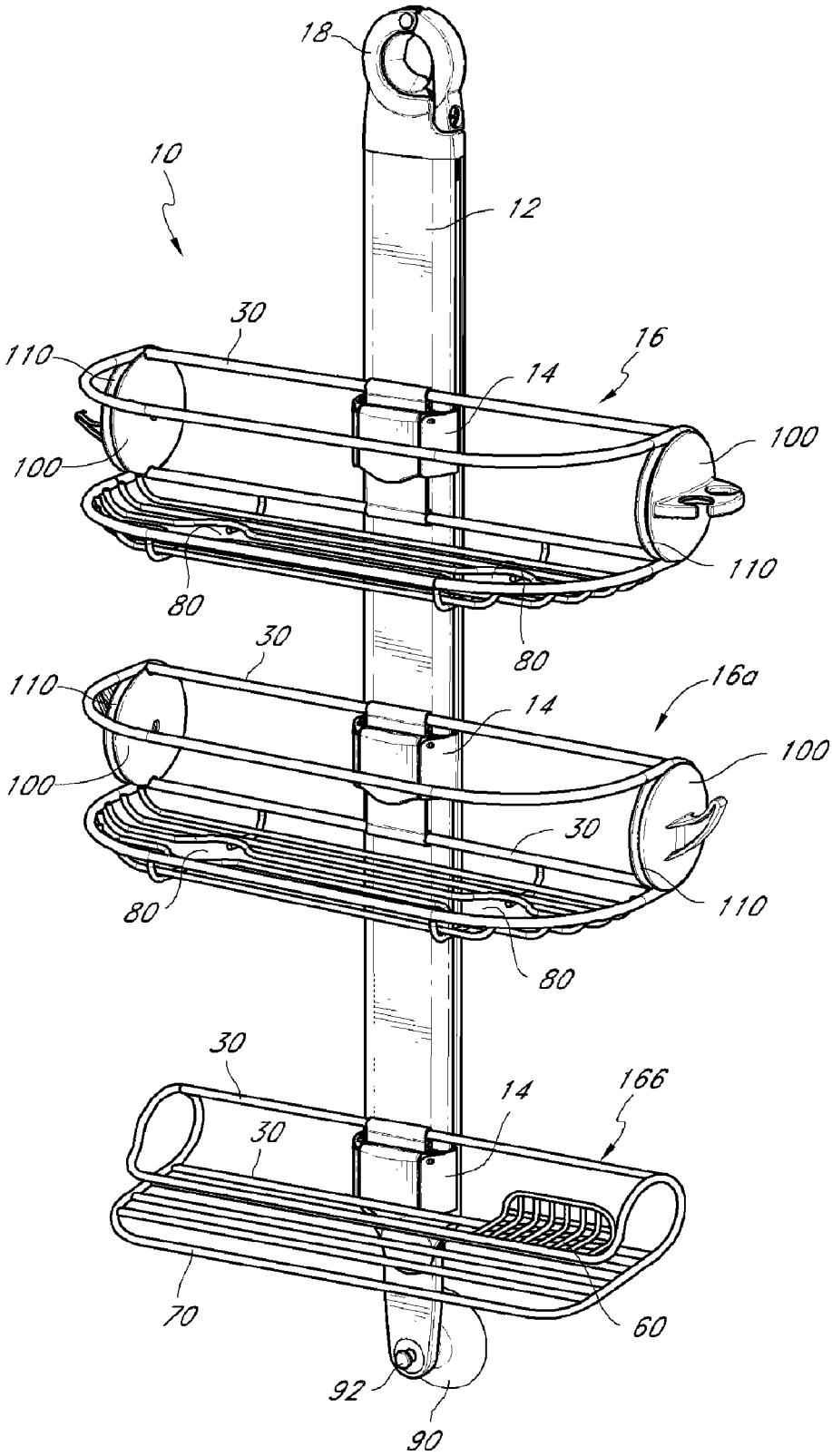
FIG. 1 is a front, top, and left side perspective view of a shower caddy constructed in accordance with an embodiment and having a central support member and three adjustable shelves.

As shown in FIG. 1, the loop mechanism 18 can be attached to the upper end of the support member 12. As shown in FIGS. 6 and 7, the loop mechanism 18 can be hinged. For example, in some embodiments, the loop mechanism can include a first portion 18A pivotally connected to a second portion 18B. In some embodiments, the pivotal connection between the first and second portions can be provided by a hinge 40.

The hinge 40 can be configured to allow the loop mechanism 18 to open, as shown in FIG. 7. The loop mechanism 18 can be secured by closing the first portion 18A over the shower head pipe 50 and tightening a threaded screw 42 in the corresponding threaded opening (not shown). However, other fasteners, devices, or mechanisms can also be used to secure the first portion 18A in the closed position.

With reference to FIG. 8, further advantages can be achieved by providing a resilient member on at least a portion of an inner periphery of the loop mechanism 18. For example, in some embodiments, the loop mechanism 18 can be additionally fitted with a resilient member, such as, for example, but without limitation, deformable members 46 on the inner periphery of the loop mechanism 18, as shown in FIGS. 6 and 7. The deformable member 46 can be made from one or a plurality of pieces. Additionally, the deformable members 46 can be made from any resilient material. In some embodiments, the deformable member 46 is made from rubber.

These deformable member 46 can be shaped and tapered such that they fit snugly around a standard shower head pipe 50. Still further advantages can be provided by tapering a lower portion of the member 46.

For example, as shown in FIG. 8, a lower portion 46A of the deformable member 46 can be tapered at the bottom. Such a taper can provide better contact with a surface of a generally vertically or laterally curved or slanted attachment point of the caddy 10.

Further, in some embodiments, the tapered shape of the lower portion 46A can be configured to compliment the typical downwardly curved contour of a shower head pipe that emerges from a shower wall 52, such as the shower head pipe 50. Such tapering of the lower portion 46A can allow the shower caddy 10 to hang more straightly.

For example, without the taper in the lower portion 46A, the lower surface of the pipe 50 would generate more pressure on a forward portion 46B of the lower portion 46A. This would generate a torque on the caddy 10, tending to pivot the caddy 10 in the direction of arrow P inwardly toward the shower wall 52. Additionally, the contact patch between such an untapered member 46 would be smaller thereby weakening the grip between the member 46 and the pipe 50.

As shown in FIGS. 6-8, the rubber insert 46 can be thinner at the top of the loop mechanism 18 as compared to the lower portion 46A. This can help to reduce bouncing of the shower caddy 10 when it is hung from the loop mechanism 18.

A typical shower head pipe 50 has an outer diameter of about 0.8 inch. In an exemplary but non-limiting embodiment, the loop mechanism 18 has a minimum inner diameter D of about 0.74 inch inner when the member 46 is in a relaxed state, e.g., when the shower caddy 10 is not installed on a shower pipe 50, as shown in FIG. 8.

The skilled artisan will appreciate that because the inner diameter D of the loop mechanism 18 is slightly smaller than the outer diameter of a typical shower pipe 50, the rubber inserts 46 will deform slightly and fit snugly around the shower pipe 50 when the loop mechanism 18 is fitted around the shower pipe 50. The skilled artisan will also understand that friction between the rubber inserts 46 and the shower head pipe 50 also helps to keep the shower caddy 10 in place by resisting relative movement between the two, thereby preventing the shower caddy 10 from sliding down the pipe 50.

This snug fit is particularly useful for stabilizing the shower caddy 10 on a shower pipe 50 when the weight of items (e.g., shampoo, soap, etc.) kept on the shelves 16 is not distributed evenly. It has been found that conventional shower caddies do not adequately resist sliding off a shower pipe. Conventional shower caddies configured to hang on a shower pipe typically are simply hung over the shower head pipe with a portion of a wire frame of the caddy and thus may be easily knocked off a shower head pipe 50 either by a user or uneven weight distribution of articles stored on the shower caddy. By providing a hinged loop mechanism 18 at the top of the shower caddy 10, the shower caddy 10 can be more securely and stably attached to a shower head pipe.

It will be understood that the above-noted dimensions are merely exemplary. The dimensions noted above depend on one another. It is also to be understood that one of ordinary skill in the art can readily very the dimensions to adapt the shower caddy 10 for a particular application through routine experimentation, in view of the disclosure herein.

Figure 9:
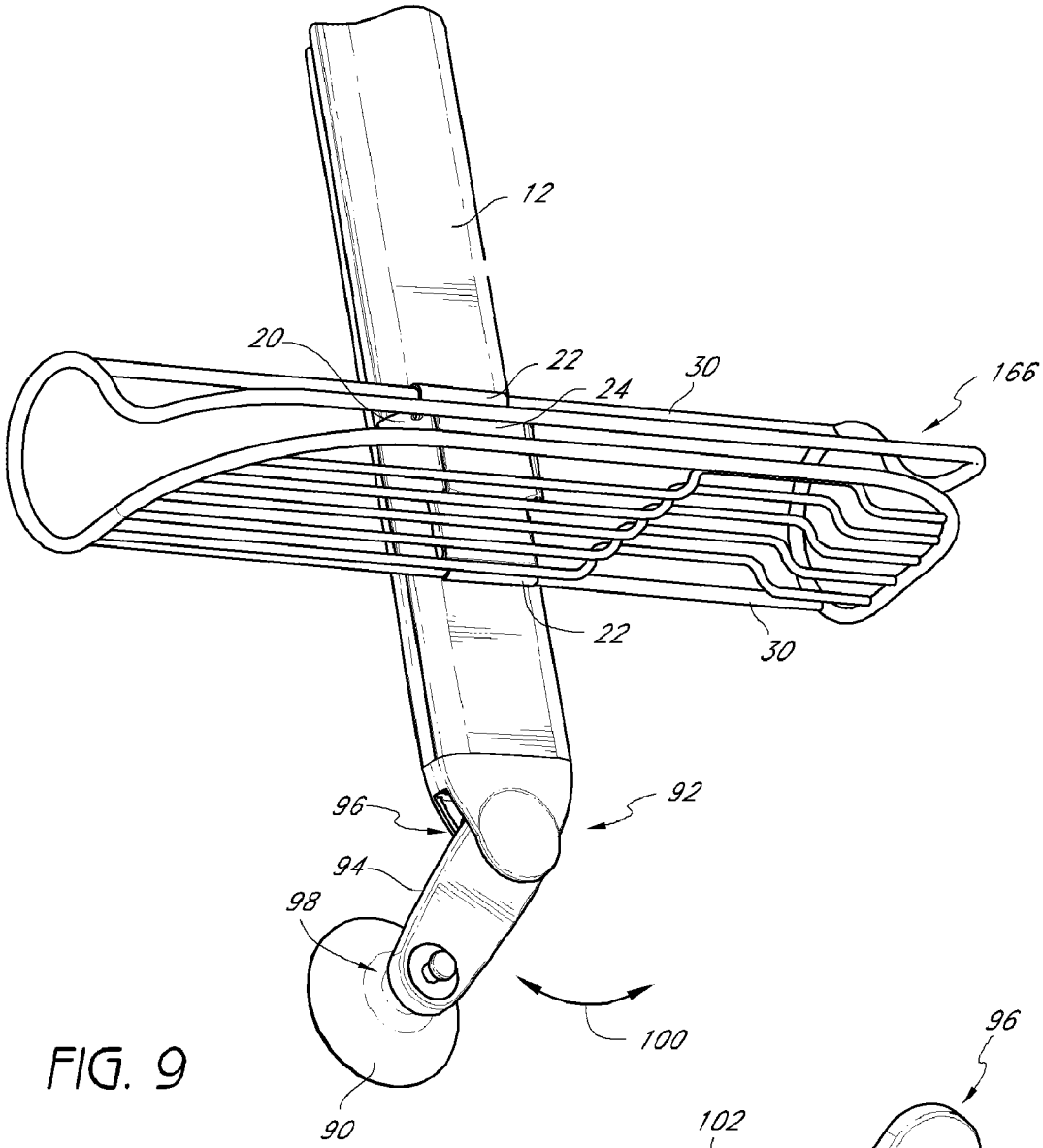
FIG. 9 is a front, bottom, and right side perspective view of a lower portion of the shower caddy having an adjustable lower attachment device.

In the illustrated embodiment, the shelves 16 are formed with cross-members 30 extending horizontally across and curved at the ends of the shelves 16 in a substantially semi-circular or "U" shape, as shown in FIGS. 1 and 9. As shown in the drawings, the shelves 16 can have different configurations. For example, the shelves 16 can be simple shelves having drainage holes or may be additionally fitted with a soap tray 60, towel rack 70, openings 80 for toiletries, and other accessories (e.g., hooks, etc). Embodiments of a soap tray 60, towel rack 70, and openings 80 for toiletries are shown in FIG. 1.

In the illustrated embodiment, the shelves 16 are configured as a wire basket, as shown in the drawings, to allow for drainage. However, it will be understood that the shelves may have different configurations other than those illustrated.

As shown in FIG. 1, the shelves 16, 16*a*, 16*b* have different configurations. The shelf 16*b* has a soap tray 60 and a towel rack 70 and the upper shelves 16, 16*a* can have openings 80 for holding bottles of toiletries such as shampoo, upside down, e.g., with the cap of the shampoo bottle extending through the openings 80. The skilled artisan will understand that there may be alternative embodiments for the soap tray 60, towel rack 70, and openings 80 for toiletries and that the embodiments shown in the drawings are merely preferred embodiments.

In a some embodiments, the baskets of each shelf 16, 16*a*, 16*b*, can be formed of polished stainless steel wire. In an exemplary but non-limiting embodiment, the frame of the basket, including the cross members 30, can be formed of 6 mm polished stainless steel wire. The remainder of the baskets can be formed of 3 mm polished stainless steel wire. However, other materials can also be used.

In some embodiments, other accessories 100 in the form of disks can be attached to the shower caddy 10. The accessories 100 can be formed in the shape of disks having a groove 110 on the peripheral edge.

The width of the groove 110 can be about the same or slightly larger than the outer diameter of the wire forming the substantially semi-circular or U-shaped portions on the ends of the shelves 16 so that the wire of the substantially semi-circular portion fits within the groove 110. The skilled artisan will understand that the disks 100 are sized and shaped to fit in the substantially semi-circular portion, as shown in FIG. 1. The grooves 110 can be configured to "snap" into place in the substantially semi-circular portion of the shelves 16 by engaging the wire of the substantially semi-circular portion.

The cross-members 30 of the shelves 16 may be pulled apart slightly by the user to snap the disks 100 in place. The skilled artisan will understand that the substantially semi-circular portion of the shelves 16 are preferably slightly greater than 180 degrees to facilitate insertion of the accessories disks 100.

The accessories disks 100 can be formed of a strong, rigid material, such as polycarbonate. The techniques for manufacturing polycarbonate disks are well known in the art and thus no further description of the methods for manufacturing the disks 100 are necessary for one of ordinary skill in the art. However, such accessories disks 100 can be made from a variety of other suitable materials and in a variety of known manners.

The shower caddy 10 can be further secured to the shower wall 52 with an attachment mechanism at the bottom of the shower caddy 10 to provide additional stability. It will also be understood that an attachment mechanism at the bottom of the shower caddy 10 also helps to prevent movement of the shower caddy 10 if, for example, a user accidentally contacts the caddy 10 or if the weight of items stored on the caddy 10 is shifted to one side.

Figure 10:
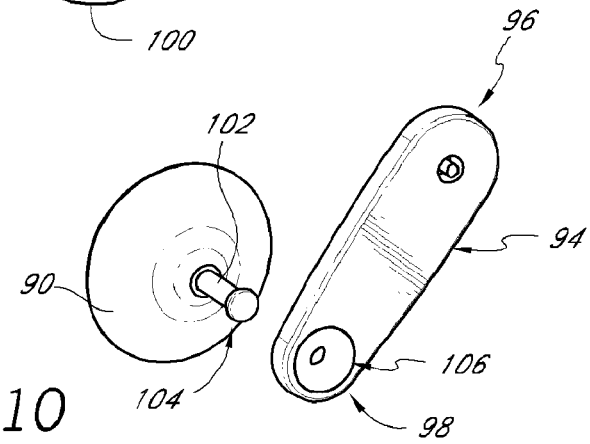
FIG. 10 is an exploded perspective view of the adjustable lower attachment device shown in FIG. 9.

As shown in FIG. 9, in a preferred embodiment, a suction cup can be 90 rotatably mounted with a mechanism 92 at the bottom of the shower caddy 10 to secure the shower caddy 10 to the shower wall 52. FIG. 10 is an exploded perspective view of the suction cup 90 and hinged mechanism 92 assembly.

The suction cup 90 can be rotatably attached to lower end of the support member 12 by the mechanism 92 or some other mechanism allowing for at least lateral adjustment of the position of the suction cup 90 with respect to the wall 52. In some embodiments, the mechanism 92 can be configured to provide both lateral (e.g., generally perpendicular to the longitudinal axis of the support member 12) and longitudinal (e.g., generally parallel to the longitudinal axis of the support member 12) adjustment of the position of the suction cup 90.

The suction cup 90 can be configured to grip a substantially flat, planar surface. As mentioned above, suction cups positioned over a grout line or another type of break or irregularity in the shower wall may not generate a satisfactory seal with a suction cup. Thus, the mechanism 92 can be configured to allow movement of the suction cup 90, without adjusting the position of the shower caddy 10, so that a user may avoid positioning the suction cup 90 over a grout line or some other type of break or irregularity in the shower wall 52.

Thus, in some embodiments, the suction cup 90 can be configured to be moveable such that it can be positioned over a smoother portion of the shower wall 52, thereby providing a strong and secure attachment to the wall 52.

In the illustrated embodiment, the mechanism 92 includes a pivot arm 94 having an upper end 96 pivotally mounted to the lower end of the support member 12 and a lower end 98 connected to the suction cup 90. In this configuration, the suction cup 90 can be pivoted along the arrow 100. As such, the suction cup 90 can be adjusted both in the longitudinal direction and the lateral direction.

The pivot arm 94 can be connected to the support member 12 and the suction cup 90 with any known device or mechanism. In some embodiments, the upper end 96 of the pivot arm can be connected to the support member 12 with a hinged connection. Additionally, in some embodiments, friction can be built into the hinged connection to simplify the process of attaching the suction cup 90 to a shower wall.

In some embodiments, the lower end 98 of the pivot arm can be configured to provide a flexible connection with the suction cup 90. In the illustrated embodiment, the suction cup 90 includes a shaft 102 with an enlarged head 104. The pivot arm, on the other hand, can include a resilient member 106 having an inner diameter, at rest, that is smaller than the outer diameter of the enlarged head 104. As such, the enlarged head 104 can be pressed through and thereby engaged with the resilient member 106. However, this is merely one exemplary but non-limiting manner in which the suction cup 90 can be attached to the support member 12. Any other device, mechanism, or method can also be used.

The skilled artisan will appreciate that, in further embodiments, the shower caddy 10 can be provided with an adjustable suction cup assembly both at the top and the bottom, thereby eliminating the loop mechanism 18. Such alternative embodiments may be secured to the shower wall anywhere as they do not need to be secured to the shower head pipe.

FIGS. 11-21 illustrate a modification of the shower caddy illustrated in FIGS. 1-10, identified generally by the reference numeral 10'. Components of the shower caddy 10' that are the same or similar to the corresponding components of the shower caddy 10 are identified below with the same reference numerals except that a "'" has been added thereto.

Figure 11:
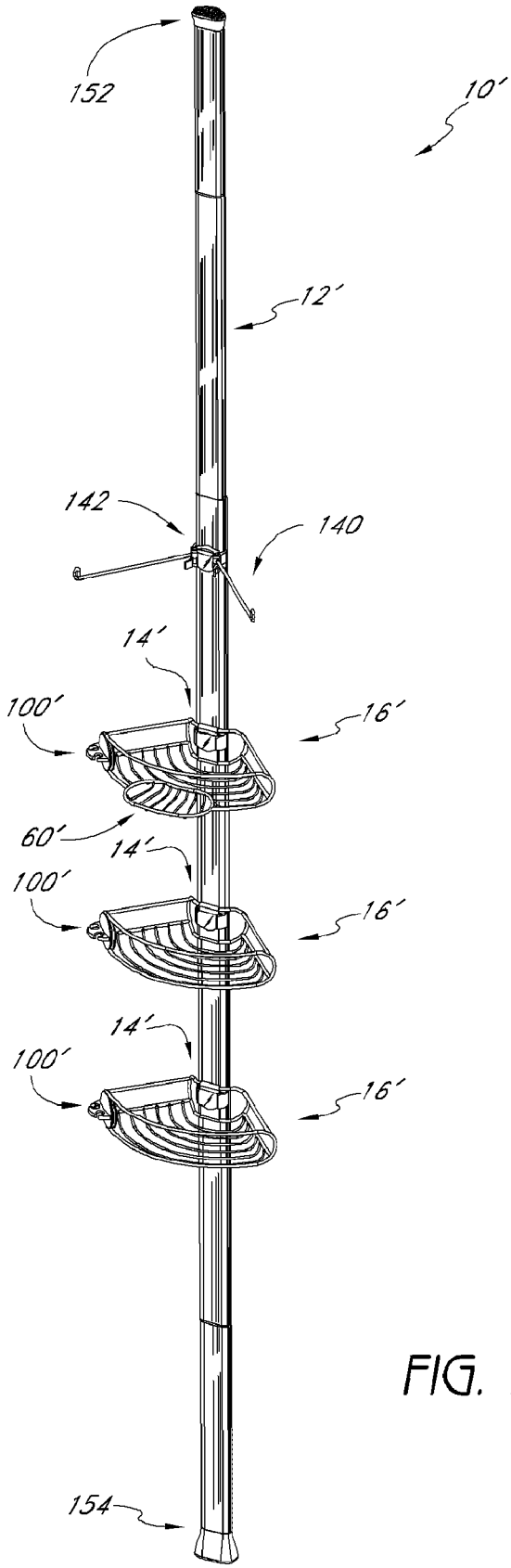
FIG. 11 is a front top and left side perspective view of a modification of the shower caddy illustrated in FIGS. 1-10.

With reference to FIG. 11, the shower caddy 10' can include an elongated support member 12', a plurality of shelves 16', each of which can be supported by clamping mechanism 14'. In some embodiments, the shower caddy 10' can also include one or a plurality of drying racks 140. In some embodiments, the drawing racks 140 can be connected to the support member 12' with the clamping mechanisms 14'. However, in the illustrated embodiment, the drying rack 140 is supported by the clamping mechanism 142, described in greater detail below.

The support member 12' can have any configuration. In the illustrated embodiment, the support member 12' can have the same or a similar cross-sectional shape to the support member 12 illustrated in FIG. 2. In the illustrated embodiment, the support member 12' includes a generally I-beam shaped cross-section. The support member 12' can also be formed in one or a plurality of segments configured to provide adjustability along various dimensions and axes.

In some embodiments, the support member 12' is configured to have a telescoping configuration so that upper and lower ends of the support member 12' can be pressed against upper and lower stationary objects. For example, in some embodiments, the support member 12' can be configured to press against the floor of a shower and the ceiling above the shower or bathtub with sufficient force to anchor the entire caddy 10' in a desired position.

Figure 11A:
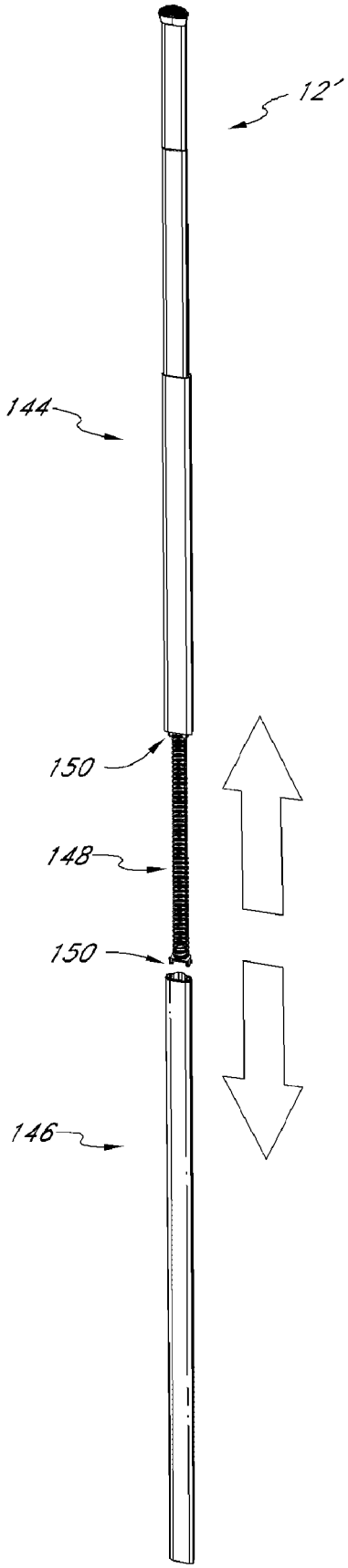
FIG. 11A is an exploded view of a central support member of the shower caddy illustrated in FIG. 11.
Figure 12:
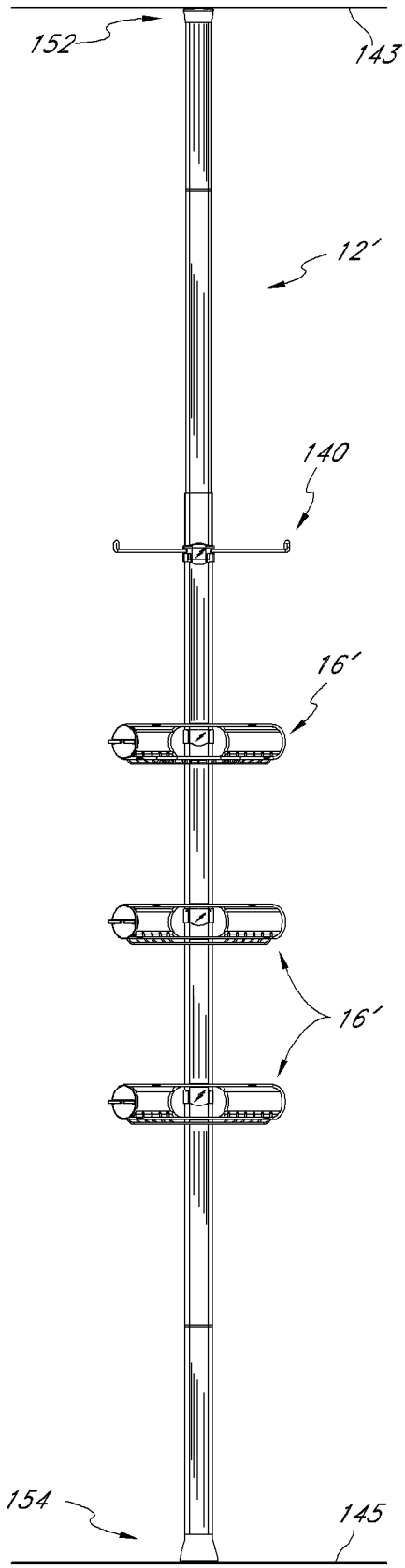
FIG. 12 is a front elevational view of the shower caddy of FIG. 11.
Figure 13:
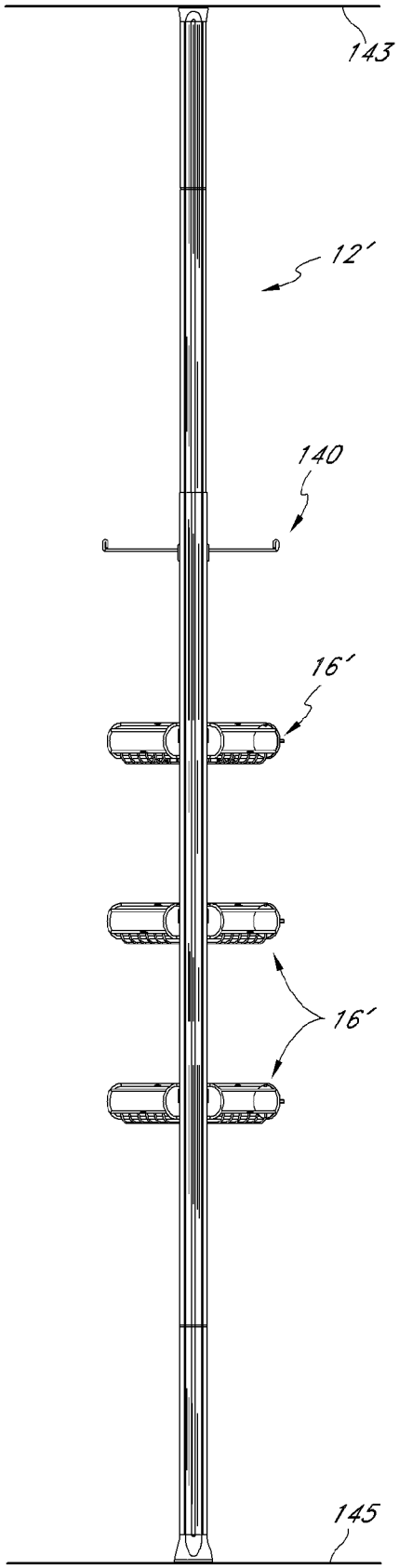
FIG. 13 is a rear elevational view of the shower caddy of FIG. 11.
Figure 14:
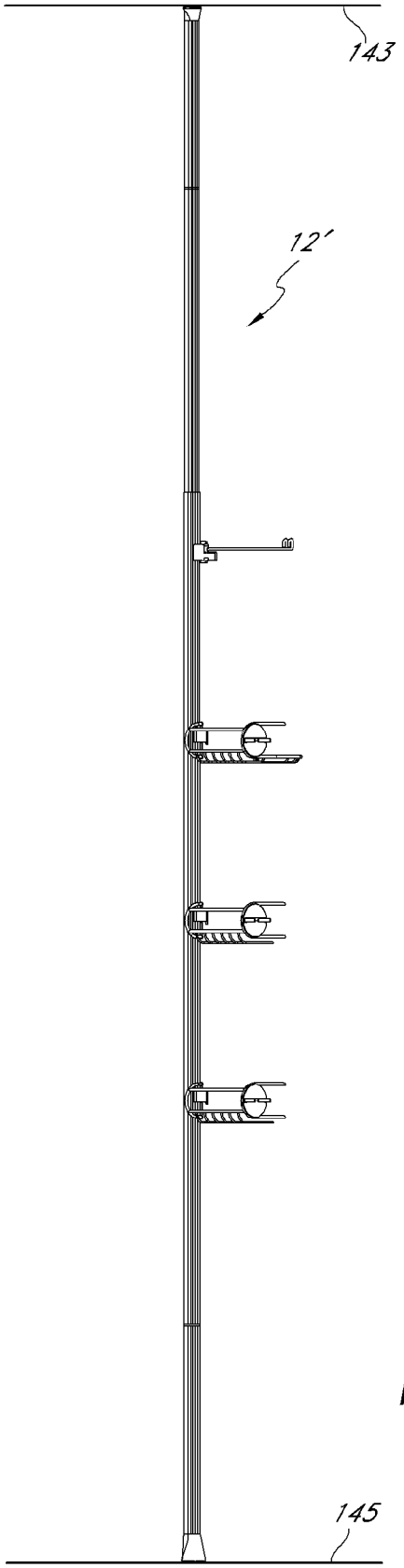
FIG. 14 is a right side elevational view of the shower caddy of FIG. 11.
Figure 15:
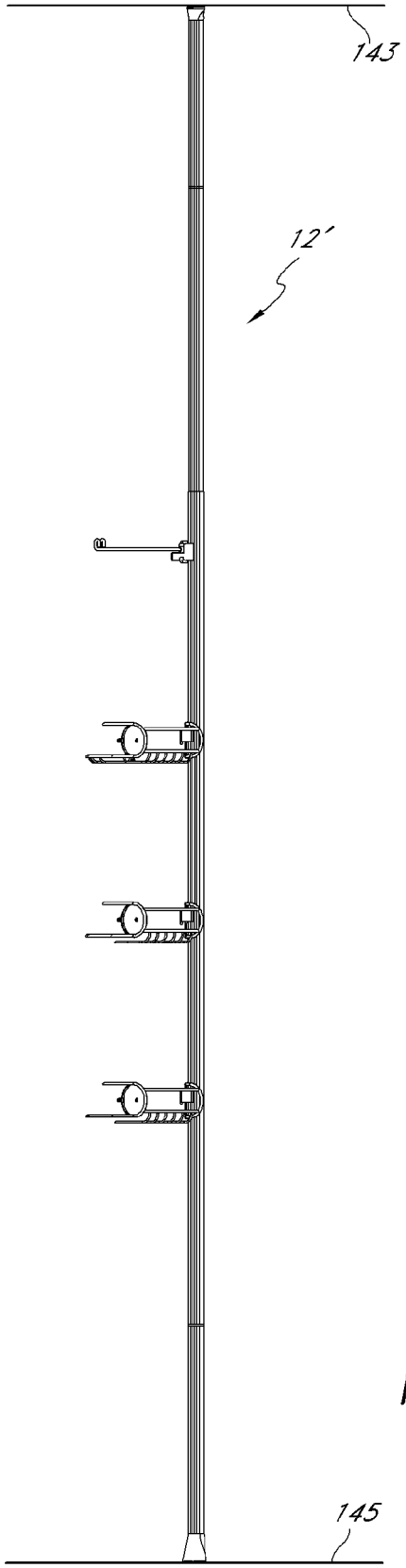
FIG. 15 is a left side elevational view of the shower caddy of FIG. 11.
Figure 16:
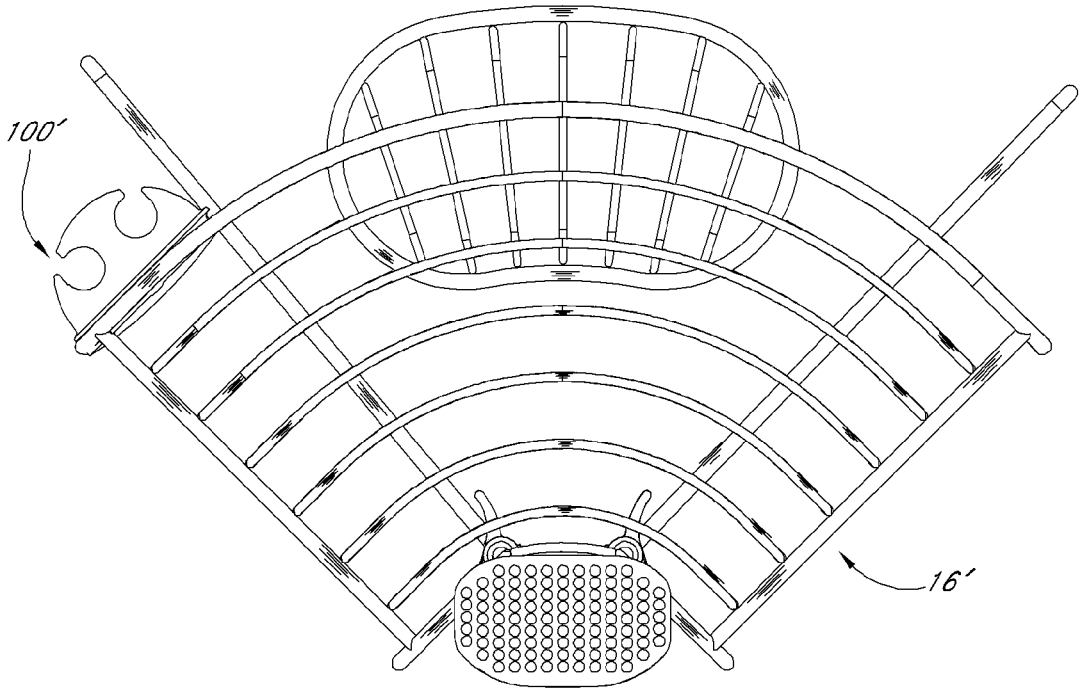
FIG. 16 is a bottom plan view of the shower caddy of FIG. 11.
Figure 17:
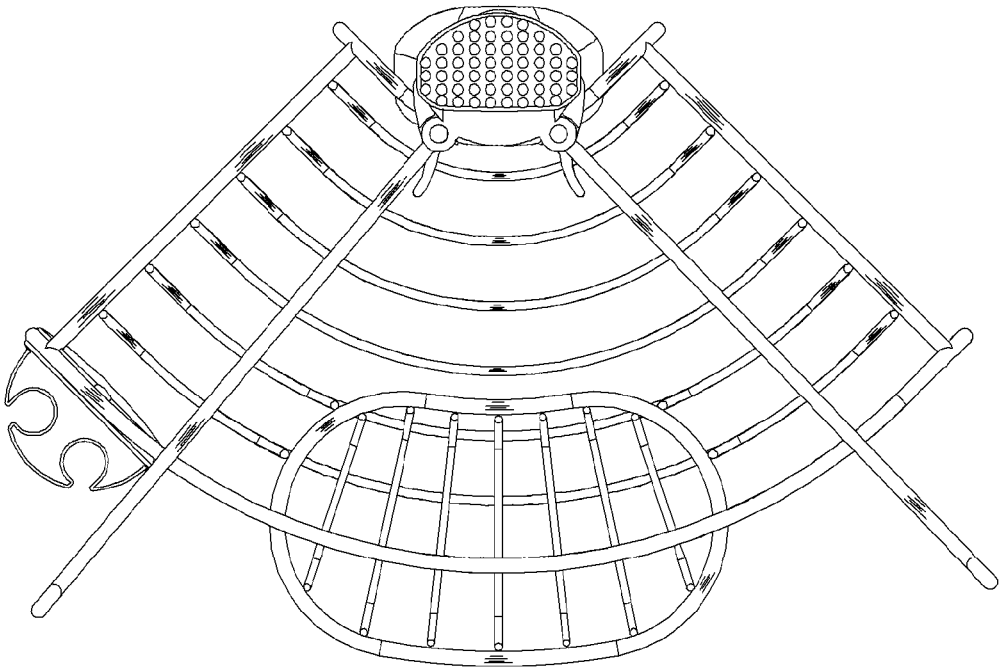
FIG. 17 is a top plan view of the shower caddy of FIG. 11.
Figure 19:
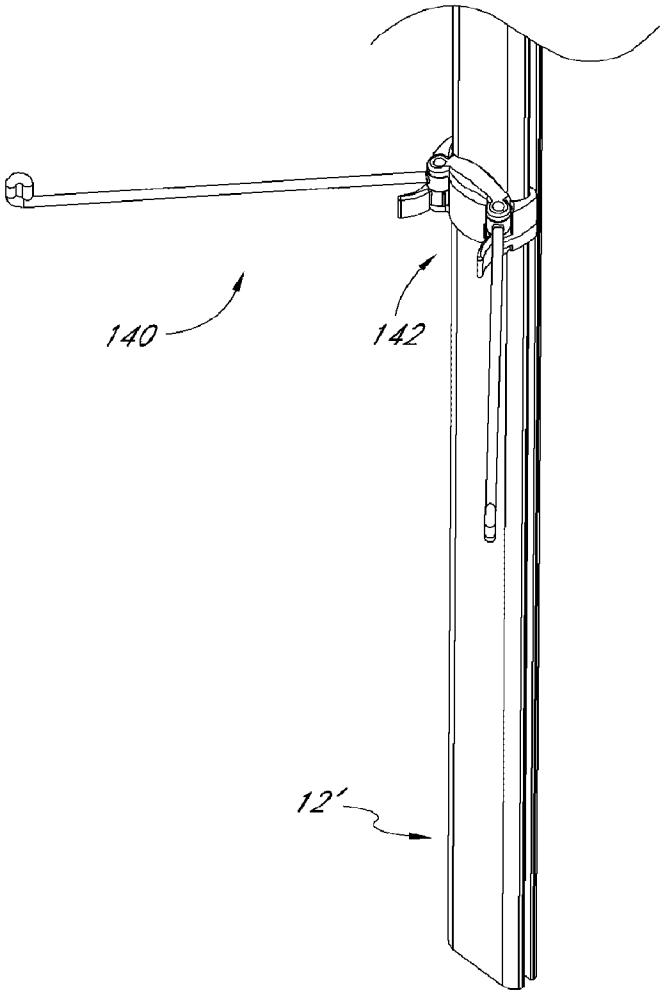
FIG. 19 is another view of the wash towel hanger of FIG. 18 attached to the central support member.
Figure 18:
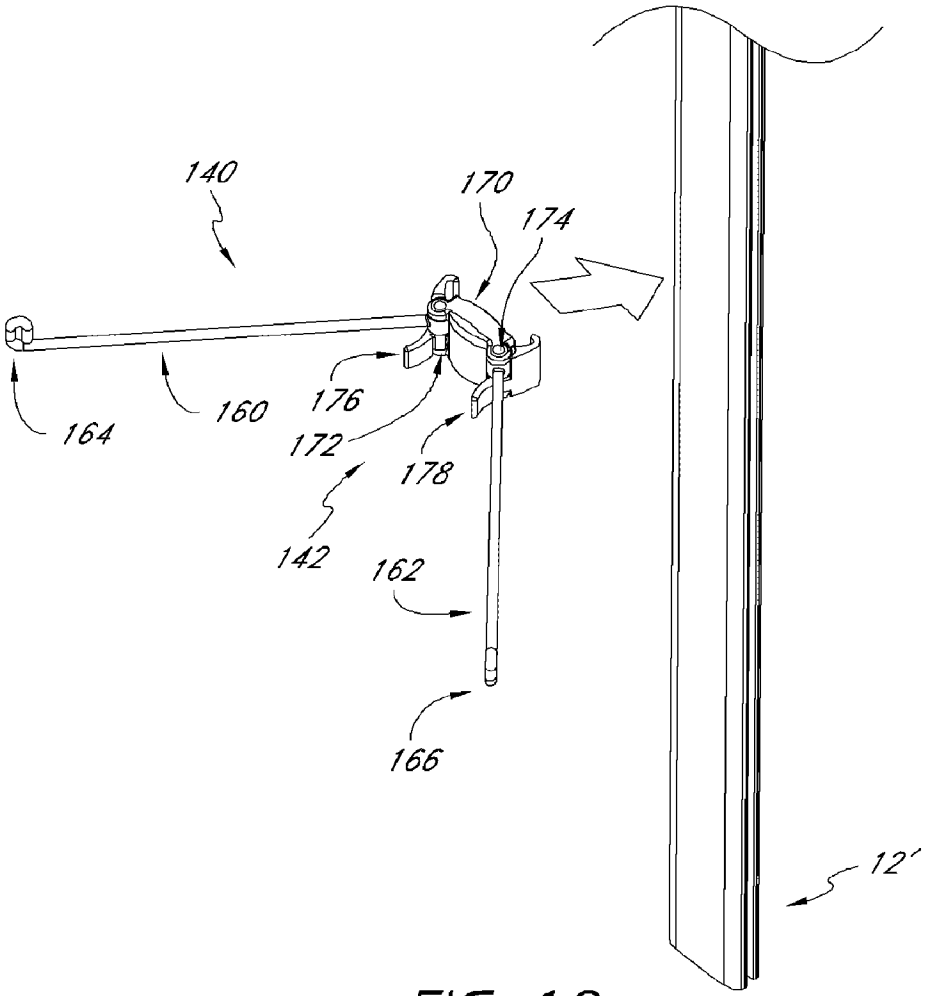
FIG. 18 is an enlarged exploded view of a wash cloth hanger illustrating motions for releasing the hanger from a central support column of the shower caddy of FIG. 11.

With reference to FIG. 11A, in some embodiments, the support member 12' can include telescoping or nesting segments 144, 146 having outer dimensions that are sized so as to allow one of the segments 144, 146 to slide within the other. For example, but without limitation, the segment 144 can be configured such that its inner dimensions are larger than the outer dimensions of the segment 146. As such, the segment 144 can extend over and thus the segment 146 can slide into the segment 144.

As noted above, the support member 12' can include a spring. In the illustrated embodiment, the support member 12' includes a spring 148 configured to bias the sections 144, 146 away from each other. As such, the support member 12' can generate an anchoring force to retain the caddy 10' (FIG. 11) in a secure position within a shower, bathtub, or other location.

Figure 20:
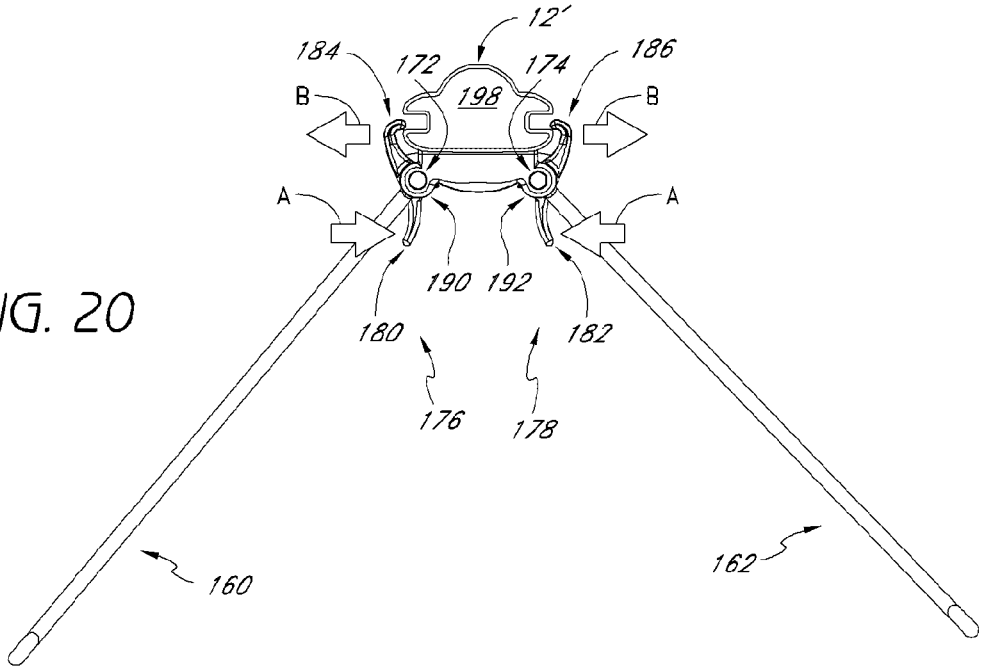
FIG. 20 is an enlarged top plan and partial sectional view illustrating a releasing motion of the wash towel hanger illustrated in FIGS. 18 and 19.

With reference to FIG. 20, the support member 12' can include an enlarged inner portion 198 configured to accommodate the spring 148 (not shown in FIG. 20). The enlarged portion 198 extends along the length of the support member 12'. As such the enlarged portion 198 serves the dual purposes of providing a space in which the spring 148 can be completely contained within the interior of the support member 12' and provides additional stiffness against bending of the support member 12'. However, other configurations can also be used.

With continued reference to FIG. 11A, the support member 12' can also include one or a plurality of mounting clips 150 configured to the engageable with portions of the segments 144, 146 to allow the spring 148 to press securely against and thus push apart the segments 144, 146.

With reference again to FIG. 11, the support member 12' can also include upper and lower feet 152, 154 configured to provide additional traction when the upper and lower ends of the support member 12' are pressed against surfaces 143, 145 such as the ceiling and floor of a shower or bathtub (See e.g. FIGS. 12-15). For example, but without limitation, the feet 152, 154 can be made of rubber, silicon, or any other material that would provide enhanced traction in such an environment of use.

As illustrated in FIGS. 11, and 12-17, the shelves 16' can have wedge or pie-shaped configuration. This provides a more compact arrangement when the shower caddy 10' is mounted in a bathtub or shower that has walls that meet at a 90° angle. In such an environment, the wedge or pie-shaped configuration of the shelves 16' allows the shower caddy 10' to be tucked compactly into such a 90 to be tucked compactly into such a 90° corner. Additionally, the shelves 16' can include accessories that are similar to or the same as the various other accessories described above with reference to the shower caddy 10.

As noted above, the shelves 16' can be secured to the support member 12' with clamping mechanisms 14'. The clamping mechanisms 14' can be the same or similar to the clamping mechanisms 14 described above in detail with reference to FIGS. 1-5. Thus, the shelves 16' can be moved vertically along the vertical length of the support member 12'. Additionally, the shelves 16' can be adjusted in a lateral direction relative to the vertical direction of the support member 12'.

With reference to FIGS. 18-21, the wash towel drying racks 140 can be configured, as noted above, to be engageable with the support member 12'. The drying rack 140 can be made in any known manner.

In the illustrated embodiment, the drying rack comprises a clamping mechanism 142 and one or a plurality of rack members 160, 162. The rack members 160, 162 can have any configuration. In the illustrated embodiment, the rack members 160, 162 are configured to support a hanging article, such as, for example, but without limitation, a wet wash cloth. In the illustrated embodiment, the rack members 160, 162 are made from rod shaped material with enlarged end portions 164, 166 to prevent the hanging article from inadvertently sliding off of the rack members 160, 162. However, other configurations can also be used.

The rack members 160, 162 can be made from a metal material, such as stainless steel. However, any material can be used.

The drying rack 140 can include a main body portion 170 configured to support the rack members 160, 162 as well as supporting and/or forming a part of the clamping mechanism 142. However, other configurations can also be used.

The main body member can support one or a plurality of pivot pins 172, 174. The pivot pins 172, 174 can be used to pivotally support the rack members 160, 162.

Further improvements can be provided where the pivot pins 172, 174 also support clamp members 176, 178. As such, the pivot pins 172, 174 provide the dual purposes of providing a pivotal support for both the rack members 160, 162 and the clamp members 176, 178.

With reference to FIG. 20, the clamp members 176, 178 can include control ends 180, 182 and engagement ends 184, 186, respectively.

The control ends 180, 182 can be configured to allow a user to control the movement of the engaging portions 184, 186. For example, the control portions 180, 182 can be shaped such that a user can comfortably grasp these portions 180, 182, optionally with one hand, and squeeze them toward each other in the direction of arrows A in FIG. 20 thereby causing the engaging portions 184, 186 to move away from the support member 12' in the direction of arrows B.

In some embodiments, the control portions 180, 182 are connected with the engaging portions 184, 186, respectively with pivot portions 190, 192. The pivot portions 190, 192 can comprise an opening configured to receive the pins 172, 174. In some embodiments, the pivot portions 190, 192 are made integrally or monolithically with the corresponding control portions 180, 182 and engaging portions 184, 186.

Figure 21:
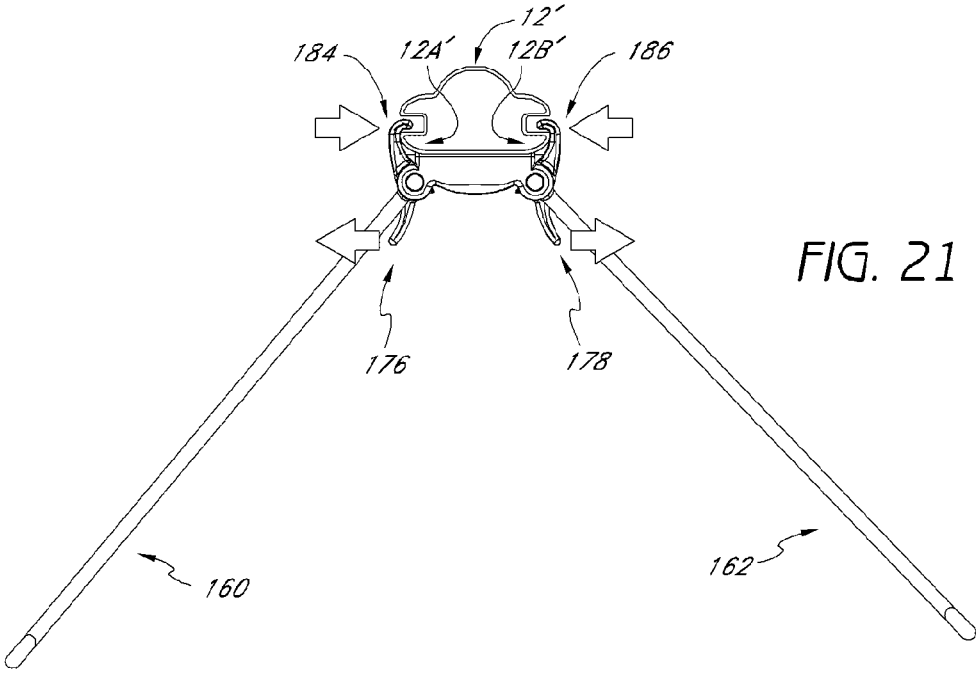
FIG. 21 is a top plan and partial sectional view of the wash cloth hanger of FIGS. 18 and 19 illustrating a clamping movement for connecting the hanger to the central support member.

Additionally, in some embodiments, the members 176, 178 can be biased toward the closed position illustrated in FIG. 21. For example, springs, such as torsional springs (not shown) can be provided in or adjacent to the pivot portions 190, 192 to bias the members 176, 178 toward the closing direction. More specifically, such springs can bias the members 176, 178 such that the engaging portions 184, 186 are biased toward a position in which the engaging portions 184, 186 extend into the channels to find by the outer flanges 12A', 12B'. Further, the springs (not shown) can be configured to bias the members 176, 178 at such with sufficient force to maintain the drying rack 140 in its vertical position along the support member 12' even when one or a plurality of wet articles, such as wet wash clothes, are hanging from the racks 160, 162. Other configurations can also be used.

With the optional arrangement of the clamping mechanism 142, the drying racks 140 can be connected to and removed easily from the support members 12 or 12'. As such, a user can quickly and conveniently change the configuration of the shower caddies 10, 10' to include or exclude such drying racks 140.

Although these inventions have been disclosed in the context of certain preferred embodiments and examples, it will be understood by those skilled in the art that the present inventions extend beyond the specifically disclosed embodiments to other alternative embodiments and/or uses of the inventions and obvious modifications and equivalents thereof. In addition, while several variations of the inventions have been shown and described in detail, other modifications, which are within the scope of these inventions, will be readily apparent to those of skill in the art based upon this disclosure. It is also contemplated that various combination or sub-combinations of the specific features and aspects of the embodiments may be made and still fall within the scope of the inventions. It should be understood that various features and aspects of the disclosed embodiments can be combined with or substituted for one another in order to form varying modes of the disclosed inventions. Thus, it is intended that the scope of at least some of the present inventions herein disclosed should not be limited by the particular disclosed embodiments described above.

What is claimed is:

1. A bathroom shelving system comprising:

an elongated support member comprising a first segment and at least a second, telescoping segment adjustable relative to the first segment, the elongated support member comprising an internal cavity and one or more outer flanges, the elongated support member comprising a first end and a second end, and a longitudinal axis extending between the first and second ends;

a spring member positioned at least partially within the internal interior cavity, the spring member attached to at least one of the first and second segments, the spring member configured to bias the first and second segments away from one another, such that the first and second ends are pressed against first and second surfaces in a bathroom; and at least one shelf member for holding bathroom toiletries, the at least one shelf member slidably connected to the elongated support member with a connection mechanism, the connection mechanism comprising a user-actuatable clamping device comprising a clamp body configured to engage the elongated support member and a lever member having a cam, the clamp body having at least one hook configured to engage the one or more outer flanges of the elongated support member, the lever member configured to pivot between locked and unlocked positions, wherein in the locked position, the cam causes the clamp body to press against the elongated central support member to support the weight of the shelf.

2. The bathroom shelving system of claim 1, wherein both a vertical and lateral position of the at least one shelf member can be adjusted when the user-actuatable device is in the unlocked position, and wherein the at least one shelf member can be locked in place when the user-actuatable device is in the locked position.

3. The bathroom shelving system of claim 1, wherein the elongated support member comprises an I-beam shaped cross-section.

4. The bathroom shelving system of claim 1, wherein the first end of the elongated support member comprises an upper foot member configured to provide traction when the first end of the elongated support member is pressed against the first surface of the bathroom, and the second end of the elongated support member comprises a lower foot member configured to provide traction when the second end of the elongated support member is pressed against the second surface of the bathroom, the upper and lower foot members comprised of rubber.

5. The bathroom shelving system of claim 1, wherein the at least one shelf member comprises a wire basket.

6. The bathroom shelving system of claim 1, wherein the at least one shelf member comprises a soap tray.

7. The bathroom shelving system of claim 1, wherein the at least one shelf member comprises a towel rack.

8. The bathroom shelving system of claim 1, wherein the at least one shelf member comprises an opening for holding a bottle of toiletries upside down.

9. A method of manufacturing a bathroom shelving system comprising:

forming an elongated support member comprising a first segment and at least a second, telescoping segment adjustable relative to the first segment, the elongated support member comprising an internal cavity and one or more outer flanges, the elongated support member comprising a first end and a second end, and a longitudinal axis extending between the first and second ends;

positioning a spring member at least partially within the internal interior cavity;

attaching the spring member to at least one of the first and second segments, the spring member configured to bias the first and second segments away from one another, such that the first and second ends can press against a first bathroom surface and a second bathroom surface; and forming at least one shelf member for holding bathroom toiletries, the at least one shelf member configured to slidably connect to the elongated support member with a connection mechanism, the connection mechanism comprising a user-actuatable clamping device comprising a clamp body and a lever member having a cam, the clamp body having at least one hook configured to engage the one or more outer flanges of the elongated support member, the lever member configured to pivot between locked and unlocked positions, wherein in the locked position, the cam causes the clamp body to press against the elongated central support member to support the weight of the shelf when the at least one shelf member is connected to the elongated support member.

10. The method of claim 9, wherein the first bathroom surface comprises a floor of a shower, and the second bathroom surface comprises a ceiling above the shower.

11. The method of claim 9, wherein the at least one shelf member comprises a wedge or generally triangular-shaped configuration.

12. The method of claim 9, wherein both a vertical and lateral position of the at least one shelf member can be adjusted when the user-actuatable device is in the unlocked position, and wherein the at least one shelf member can be locked in place when the user-actuatable device is in the locked position.

13. The method of claim 9, wherein the elongated support member comprises an I-beam shaped cross-section.

14. The method of claim 9, wherein the first end of the elongated support member comprises an upper foot member configured to provide traction when the first end of the elongated support member is pressed against the first bathroom surface, and the second end of the elongated support member comprises a lower foot member configured to provide traction when the second end of the elongated support member is pressed against the second bathroom surface, the upper and lower foot members comprised of rubber.

15. The method of claim 9, wherein the at least one shelf member comprises a wire basket.

16. The method of claim 9, wherein the at least one shelf member comprises a soap tray.

17. The method of claim 9, wherein the at least one shelf member comprises a towel rack.

18. The method of claim 9, wherein the at least one shelf member comprises an opening for holding a bottle of toiletries upside down.

19. The method of claim 9, wherein the first bathroom surface comprises an upper stationary object, and the second bathroom surface comprises a lower stationary object.

20. The method of claim 19, wherein the upper stationary object comprises a ceiling above a shower, and the lower stationary object comprises an edge of a bathtub.

21. The method of claim 9, wherein the elongated member comprises a third segment attached to the second segment, and wherein the first bathroom surface comprises a floor of a shower, and the second bathroom surface comprises a ceiling of a shower.

* * * * *